US009939785B2

(12) United States Patent
Koyama

(10) Patent No.: US 9,939,785 B2
(45) Date of Patent: Apr. 10, 2018

(54) POINTER DRIVING MOTOR UNIT, ELECTRONIC DEVICE, AND CONTROL METHOD OF POINTER DRIVING MOTOR UNIT

(71) Applicant: Seiko Instruments Inc., Chiba-shi, Chiba (JP)

(72) Inventor: Kazuhiro Koyama, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/394,049

(22) Filed: Dec. 29, 2016

(65) Prior Publication Data

US 2017/0192394 A1 Jul. 6, 2017

(30) Foreign Application Priority Data

Jan. 5, 2016 (JP) ..... 2016-000687
Oct. 19, 2016 (JP) ..... 2016-205424

(51) Int. Cl.
*G04C 3/00* (2006.01)
*G04C 3/14* (2006.01)
*G04B 19/04* (2006.01)

(52) U.S. Cl.
CPC ..... *G04C 3/14* (2013.01); *G04B 19/04* (2013.01); *G04C 3/008* (2013.01)

(58) Field of Classification Search
CPC ..... G04B 19/04; G04C 3/00; G04C 3/008; G04C 3/14; G04C 3/18; G04G 17/02; G04G 17/04
See application file for complete search history.

(56) References Cited

U.S. PATENT DOCUMENTS 4,681,464 A * 7/1987 Ray ..... G04F 8/00 368/157
5,008,868 A * 4/1991 Ikegami ..... G04G 17/04 368/87
9,256,209 B2 * 2/2016 Yang ..... G04C 3/00
(Continued)

FOREIGN PATENT DOCUMENTS

JP 2002-323577 A 11/2002

*Primary Examiner* — Vit W Miska
(74) *Attorney, Agent, or Firm* — Brinks Gilson & Lione

(57) ABSTRACT

An object is to provide a pointer driving motor unit which can easily control driving of a pointer of a time piece by a stepping motor, a multifunctional electronic device, and a control method of a pointer driving motor unit. A pointer driving motor unit includes: a supporting body; a stepping motor which rotates a pointer that is supported to be rotatable with respect to the supporting body; a plurality of input portions which include a first input portion into which a first instruction signal is input from a main control portion, and a second input portion into which a second instruction signal is input from the main control portion; and a control portion which is provided in the supporting body, outputs a first driving signal that drives the pointer by a first operation to the stepping motor based on a result of comparing the first instruction signal and a predetermined threshold value with each other, and outputs a second driving signal that drives the pointer by a second operation to the stepping motor based on a result of comparing the second instruction signal and a predetermined threshold value with each other.

12 Claims, 15 Drawing Sheets

(56) References Cited

U.S. PATENT DOCUMENTS

| | | | | |
|---|---|---|---|---|
| 2007/0008823 | A1* | 1/2007 | Plancon | G04C 3/008 368/28 |
| 2007/0291593 | A1* | 12/2007 | Tokoro | G04B 19/241 368/221 |
| 2010/0220559 | A1 | 9/2010 | Galie et al. | |

* cited by examiner

Fig. 2

55a

| TYPE OF PORT TERMINAL | OPERATION PATTERN OF POINTER | DRIVING SIGNAL |
|---|---|---|
| FIRST PORT TERMINAL | 1-SECOND POINTER HANDLING | SIG_A |
| SECOND PORT TERMINAL | 1 NORMAL ROTATION | SIG_B |
| THIRD PORT TERMINAL | 1 REVERSE ROTATION | SIG_C |
| FOURTH PORT TERMINAL | COUNTDOWN (-1-SECOND POINTER HANDLING) | SIG_D |
| FIFTH PORT TERMINAL | PREDETERMINED CONTINUOUS OPERATION | SIG_E |
| SIXTH PORT TERMINAL | 1-SECOND POINTER HANDLING OR -1-SECOND POINTER HANDLING | SIG_F |

Fig. 3

55b

| CONTROL ITEM | SLOT NO. | | | | | FREQUENCY |
|---|---|---|---|---|---|---|
| | 1 | 2 | 3 | ··· | N | |
| POINTER DRIVING SPEED | ··· | ··· | ··· | ··· | ··· | 64Hz |
| ROTATIONAL DIRECTION | ··· | ··· | ··· | ··· | ··· | 64Hz |
| ROTATION ANGLE | ··· | ··· | ··· | ··· | ··· | 64Hz |
| OPERATION START POSITION | ··· | ··· | ··· | ··· | ··· | 64Hz |
| PROPRIETY OF RECIPROCATION | ··· | ··· | ··· | ··· | ··· | 64Hz |
| ··· | ··· | ··· | ··· | ··· | ··· | ··· |

*Fig. 13*

55a

| TYPE OF PORT TERMINAL | OPERATION PATTERN OF POINTER HANDLING | DRIVING SIGNAL | OUTPUT DESTINATION |
|---|---|---|---|
| FIRST PORT TERMINAL | 1-SECOND POINTER HANDLING | SIG_A | FIRST POINTER DRIVING MOTOR UNIT |
| SECOND PORT TERMINAL | 1 NORMAL ROTATION | SIG_B | |
| THIRD PORT TERMINAL | 1 REVERSE ROTATION | SIG_C | SECOND POINTER DRIVING MOTOR UNIT |
| FOURTH PORT TERMINAL | COUNTDOWN (-1-SECOND POINTER HANDLING) | SIG_D | THIRD POINTER DRIVING MOTOR UNIT |
| FIFTH PORT TERMINAL | PREDETERMINED CONTINUOUS OPERATION | SIG_E | ADDITIONAL UNIT |
| SIXTH PORT TERMINAL | 1-SECOND POINTER HANDLING OR -1-SECOND POINTER HANDLING | SIG_F | FIRST POINTER DRIVING MOTOR UNIT |

*Fig. 15*

55a

| TYPE OF PORT TERMINAL | OPERATION PATTERN OF POINTER HANDLING | DRIVING SIGNAL | OUTPUT DESTINATION |
|---|---|---|---|
| FIRST PORT TERMINAL | 1 NORMAL ROTATION OF FIRST POINTER | SIG_A | FIRST MOTOR |
| SECOND PORT TERMINAL | 1 REVERSE ROTATION OF FIRST POINTER | SIG_B | |
| THIRD PORT TERMINAL | 1 NORMAL ROTATION OF SECOND POINTER | SIG_C | SECOND MOTOR |
| FOURTH PORT TERMINAL | 1 REVERSE ROTATION OF SECOND POINTER | SIG_D | |
| FIFTH PORT TERMINAL | 1 NORMAL ROTATION OF THIRD POINTER | SIG_E | THIRD MOTOR |
| SIXTH PORT TERMINAL | 1 REVERSE ROTATION OF THIRD POINTER | SIG_F | |

POINTER DRIVING MOTOR UNIT, ELECTRONIC DEVICE, AND CONTROL METHOD OF POINTER DRIVING MOTOR UNIT

RELATED APPLICATIONS

This application claims priority under 35 U.S.C. § 119 to Japanese Patent Application No. 2016-000687 filed on Jan. 5, 2016, and No. 2016-205424 filed on Oct. 19, 2016, the entire contents of which are hereby incorporated by reference.

BACKGROUND OF THE INVENTION

1. Field of the Invention

The present invention relates to a pointer driving motor unit, an electronic device, and a control method of a pointer driving motor unit.

2. Description of the Related Art

As a technology in the related art, an electronic time piece which is configured of a time display unit and an additional unit, is known (for example, refer to JP-A-2002-323577). For example, on the time display unit, a crystal resonator, a metal-oxide-semiconductor integrated circuit (MOSIC) chip, a wheel train, a motor, or a battery is loaded, and on the additional unit, a driving IC for an additional function or the like is loaded. The time piece display unit has the battery which becomes a power source that drives a main control portion (microcomputer) loaded thereon, and also has a crystal which becomes a reference clock of a system including the main control portion loaded thereon, and the entire unit is configured to be completed as a time piece. In other words, the time piece display unit is a unit made by unitizing a movement of an analogue time piece in the related art.

However, in the technology in the related art described in JP-A-2002-323577, only by simply unitizing the movement, the main control portion is also mounted in addition to the motor in the unit, and thus, a restriction on reducing the size of the unit is generated. In addition, even when the main control portion is taken out to the outside of the unit, there is a case where the driving of the pointer of the unit is controlled in accordance with the characteristics of the motor in each unit, and thus, there is a concern that the control from the main control portion on the outside becomes complicated, and there is a concern that the unit control is not appropriately performed.

SUMMARY OF THE INVENTION

Considering the above-described points, an object of the present invention is to provide a pointer driving motor unit which can easily control driving of a pointer of a time piece by a stepping motor, an electronic device, and a control method of a pointer driving motor unit.

In order to achieve the above-described object, a pointer driving motor unit according to an aspect of the present invention includes: a supporting body; a stepping motor which rotates a pointer that is supported to be rotatable with respect to the supporting body; a plurality of input portions which include a first input portion into which a first instruction signal is input from a main control portion that is connected to the supporting body from the outside of the supporting body, and a second input portion into which a second instruction signal is input from the main control portion; and a control portion which is provided in the supporting body, outputs a first driving signal that drives the pointer by a first operation to the stepping motor based on a result of comparing the first instruction signal input to the first input portion and a predetermined threshold value with each other, and outputs a second driving signal that drives the pointer by a second operation to the stepping motor based on a result of comparing the second instruction signal input to the second input portion and a predetermined threshold value with each other.

In addition, in the pointer driving motor unit according to an aspect of the present invention, a storage portion in which a correspondence table indicating a correspondence relationship including a correspondence relationship between the first input portion and the first driving signal, and a correspondence relationship between the second input portion and the second driving signal, is stored, may further be provided.

In addition, in the pointer driving motor unit according to an aspect of the present invention, the stepping motor may include a first stepping motor that rotates a first pointer, and a second stepping motor that rotates a second pointer, and the control portion may output the first driving signal to at least one or both of the first stepping motor and the second stepping motor based on characteristics of a pulse of the first instruction signal input to the first input portion, and may output the second driving signal to at least one or both of the first stepping motor and the second stepping motor based on characteristics of a pulse of the second instruction signal input to the second input portion.

In addition, in the pointer driving motor unit according to an aspect of the present invention, the input portion may include a third input portion into which a third instruction signal is input from the main control portion, and a fourth input portion into which a fourth instruction signal is input from the main control portion, the stepping motor may include a first stepping motor that rotates a first pointer and a second stepping motor that rotates a second pointer, the control portion may output the first driving signal which normally rotates the first stepping motor to the first stepping motor in accordance with the pulse of the first instruction signal input to the first input portion, may output the second driving signal which reversely rotates the first stepping motor to the first stepping motor in accordance with the pulse of second instruction signal input to the second input portion, may output the third driving signal which normally rotates the second stepping motor to the second stepping motor in accordance with the pulse of the third instruction signal input to the third input portion, and may output the fourth driving signal which reversely rotates the second stepping motor to the second stepping motor in accordance with the pulse of the fourth instruction signal input to the fourth input portion, and the storage portion may store a correspondence relationship including a correspondence relationship between the third input portion and the third driving signal, and a correspondence relationship between the fourth input portion and the fourth driving signal.

In addition, in the pointer driving motor unit according to an aspect of the present invention, characteristics of the pulse may include any of an amplitude of the pulse, a width of the pulse, a duty ratio, a frequency, and the number of pulses, or a combination thereof.

In order to achieve the above-described object, an electronic device according to an aspect of the present invention, which is capable of indicating a time, as a time piece by the pointer, may include: the above-described pointer driving motor unit; a substrate on which the main control portion is disposed; a connection portion which connects the main control portion to each of the plural input portions; and a mounting portion which is wearable by a user.

In order to achieve the above-described object, in a control method of a pointer driving motor unit according to an aspect of the present invention, including a supporting body, a stepping motor which rotates a pointer that is supported to be rotatable with respect to the supporting body, a plurality of input portions which include a first input portion into which a first instruction signal is input from a main control portion that is connected to the supporting body from the outside of the supporting body, and a second input portion into which a second instruction signal is input from the main control portion; and a control portion which is provided in the supporting body, the control portion outputs a first driving signal that drives the pointer by a first operation to the stepping motor based on a result of comparing the first instruction signal input to the first input portion and a predetermined threshold value with each other, and outputs a second driving signal that drives the pointer by a second operation to the stepping motor based on a result of comparing the second instruction signal input to the second input portion and a predetermined threshold value with each other.

According to the present invention, it is possible to easily control the driving of the pointer of the time piece by the stepping motor.

BRIEF DESCRIPTION OF THE DRAWINGS

FIG. 2 is a view illustrating an example of a driving signal correspondence table 55*a* stored in a storage portion 55.

FIG. 3 is a view illustrating an example of a driving signal SIG_E generation table 55*b* stored in the storage portion 55.

FIG. 13 is a view illustrating an example of the driving signal correspondence table 55*a* stored by the storage portion 55 in the second embodiment.

FIG. 15 is a view illustrating an example of the driving signal correspondence table 55*a* stored by the storage portion 55 in the third embodiment.

DETAILED DESCRIPTION OF THE PREFERRED EMBODIMENTS

Hereinafter, embodiments of the present invention will be described with reference to the drawings.

First Embodiment

Figure 1:
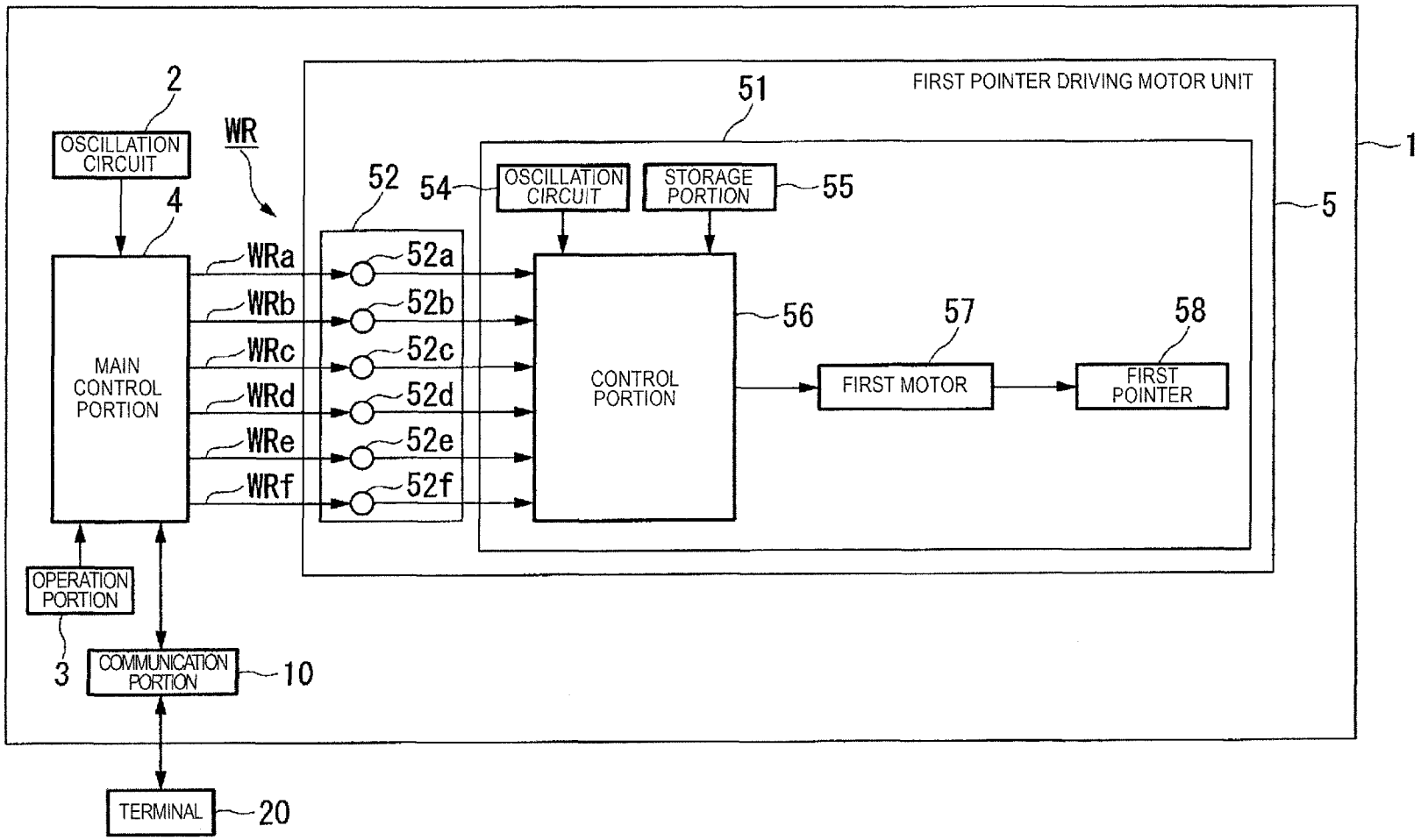
FIG. 1 is a configuration view illustrating a configuration of an electronic device 1 including a pointer driving motor unit in a first embodiment.

FIG. 1 is a configuration view illustrating a configuration of an electronic device 1 including a pointer driving motor unit in a first embodiment. The electronic device 1 in the first embodiment is, for example, a smart watch having a wireless communication function. For example, the electronic device 1 is operated in accordance with a command of an external apparatus. In addition, the electronic device 1 may be an electronic time piece which can execute a program received from the external apparatus, such as a terminal 20. In addition, the electronic device 1 may be an electronic time piece which accesses a network including a relay device, such as a base station or a router, and downloads the program.

The electronic device 1 includes, for example, an oscillation circuit 2, an operation portion 3, a main control portion 4, a first pointer driving motor unit 5, and a communication portion 10. In addition, the electronic device 1 includes a belt (mounting portion) BL (refer to FIG. 4 which will be described later) which is wearable on an arm or the like. In addition, the electronic device 1 communicates with the terminal 20, and sends and receives information. The terminal 20 is, for example, a smartphone (multifunctional portable phone), a tablet terminal, a personal computer, a portable game device, a home network device, an onboard system device or the like.

The oscillation circuit 2, the operation portion 3, and the communication portion 10 are connected to the main control portion 4. The main control portion 4 is disposed in a supporting body (substrate) which is different from a supporting body 51 in which the first pointer driving motor unit 5 which will be described later is disposed, and is connected to the first pointer driving motor unit 5 via n (n is an arbitrary number) signal lines WR. The number of signal lines WR may be changed in accordance with the type of a signal output to the first pointer driving motor unit 5 from the main control portion 4. In the embodiment, as an example, an example in which 6 (n=6) signal lines WR are connected to the main control portion 4 and the first pointer driving motor unit 5, will be described. The signal line WR is an example of a "connection portion".

The oscillation circuit 2 includes, for example, a crystal resonator of 32.768 kHz, divides a signal generated by the crystal resonator, generates a reference signal for counting the time in the main control portion 4, and outputs the generated reference signal to the main control portion 4.

The operation portion 3 is, for example, a knob or a button. In a case where the operation portion 3 is operated (for example, a rotation operation or a pressing operation) by a user, the operation portion 3 outputs an operation signal which corresponds to the operation to the main control portion 4. In the operation signal, for example, an adjustment command (time setting command) of a position of each pointer, a measuring start command of a chronograph, a measuring finish command of the chronograph, a command of resetting the display of the chronograph, or a time setting of an alarm, is included.

The communication portion 10 sends and receives the command or the information between the communication portion 10 and the terminal 20, for example, by using a communication method of a wireless fidelity (Wi-Fi) standard or a Bluetooth (registered trademark) low energy (LE) (hereinafter, refer to as BLE). In the command received from the terminal 20, for example, a command of handling the pointer for 1 seconds, a command of driving the pointer by a predetermined angle in the forward direction (clockwise), a command of driving the pointer by a predetermined angle in the reverse direction (counterclockwise), a command of counting down (handling the pointer for −1 seconds) using the current time as a reference, a command of continuously driving the pointer, or a command of stopping the handling of the pointer for 1 seconds or for −1 seconds, is included.

The communication portion 10 outputs the information received from the terminal 20 to the main control portion 4. In addition, the communication portion 10 sends the information output by the main control portion 4 to the external apparatus, such as the terminal 20. In the information output by the main control portion 4, for example, response with respect to the information received from the terminal 20, information indicating the number of units provided in the electronic device 1, information indicating the number of pointers provided in the electronic device 1, and the like, may be included.

The main control portion 4 controls the operation of the electronic device 1 by executing the program stored in a storage portion (not illustrated) by a processor, such as a central processing unit (CPU). In addition, the CPU is a unit which is written as a concept including a microcomputer unit (MPU) or a microcomputer (MCU), and any of the functions, actions, and effects of the present invention may be achieved.

The main control portion 4 obtains a command output by the communication portion 10, and controls the corresponding signal line WR in accordance with the obtained command. In a case where the main control portion 4 obtains a command of handling the pointer for 1 seconds, in a signal line WRa, the main control portion 4 change a level of the signal from a level which is less than a threshold value (hereinafter, refer to as a low (L) level) to a level which equal to or greater than a threshold value (hereinafter, referred to as a high (H) level) during a predetermined period of time. In addition, the main control portion 4 may change the level of the signal from the H level to the L level during a predetermined period of time. In any case, by detecting whether or not the level exceeds the predetermined threshold value, the change from the L level to the H level or the change from the H level to the L level, is detected.

In a case where the main control portion 4 obtains the command of driving the pointer by a predetermined angle in the forward direction (clockwise), the main control portion 4 changes a level of a signal line WRb from the L level to the H level during a predetermined period of time. In a case where the main control portion 4 obtains the command of driving the pointer by the predetermined angle in the reverse direction (counterclockwise), the main control portion 4 changes a level of a signal line WRc from the L level to the H level. In a case where the main control portion 4 obtains the command of counting down (handling the pointer for −1 seconds) using the current time as a reference, the main control portion 4 changes a level of a signal line WRd from the L level to the H level. In a case where the main control portion 4 obtains the command of continuously operating the pointer, the main control portion 4 changes a level of a signal line WRe from the L level to the H level for a predetermined time. In a case where the main control portion 4 obtains the command of stopping the handling of the pointer for 1 seconds or for −1 seconds, the main control portion 4 changes a level of a signal line WRf from the L level to the H level. In addition, in the embodiment, the signal output to the control portion 56 by the main control portion 4 is also called an instruction signal. In addition, in the embodiment, any one of the instruction signals output from the signal line WRa to the WRf, is a "first instruction signal", and at least one of remaining instruction signals is a "second instruction signal".

In this manner, in the embodiment, only by changing the signal level of the corresponding signal line WR from the L level to the H level in accordance with the command sent by the terminal 20 which is the external apparatus, the main control portion 4 controls the first pointer driving motor unit 5.

In addition, in the instruction signal, a signal parameter, such as an amplitude (signal level) of a pulse signal, a width of the pulse, a duty ratio, a frequency, or the number of pulses, may vary in each signal line WR, or the signal parameters may be the same regardless of the type of the signal line WR to be output. The signal parameter in the instruction signal is an index which indicates an example of an "characteristics of the pulse". In addition, not being limited to the rectangular pulse signal, the instruction signal may be a triangular signal, a sawtooth wave signal, a sinusoidal signal, and an impulse signal.

In addition, in a case where the communication portion 10 receives the information continuously from the terminal 20, the main control portion 4 outputs the instruction signal to the signal line WR in an order of reception.

The first pointer driving motor unit 5 includes the supporting body 51, an input portion 52, an oscillation circuit 54, a storage portion 55, the control portion 56, a first motor 57, and a first pointer 58. In addition, there is also a case where an aspect in which the first pointer 58 is attached to the outside of the first pointer driving motor unit 5 is achieved.

The supporting body 51 includes the substrate, a ground board which becomes a base, a receiving board which suppresses a component disposed on the ground board from the opposite side, another case portion, a bearing to which a rotation shaft of the first motor 57 is bonded, and the like. The substrate is disposed on the ground board, and on the substrate, a wiring, the input portion 52, the oscillation circuit 54, the storage portion 55, the control portion 56, the first motor 57, a wheel train which is a gear train that transmits the torque from the motor, and the like, are disposed. A unit is assembled by fastening the components using the receiving board. In addition, on the ground board, an electrode which becomes a connection terminal that will be described later is disposed, and the electrode plays a role of making an electronic component on the inside and the outside of the unit electrically conducted with each other.

The input portion 52 is a communication interface of the control portion 56. The input portion 52 includes a first port terminal 52*a* which is connected to the signal line WRa, a second port terminal 52*b* which is connected to the signal line WRb, a third port terminal 52*c* which is connected to the signal line WRc, a fourth port terminal 52*d* which is connected to the signal line WRd, a fifth port terminal 52*e* which is connected to the signal line WRe, and a sixth port terminal 52*f* which is connected to the signal line WRf. In the example of FIG. 1, each port terminal of the input portion 52 is provided to be separated from the supporting body 51 in which the control portion 56 is installed, but the present invention is not limited thereto. Each port terminal of the input portion 52 may be provided as a socket on a physical layer on the inside of the control portion 56, or may be an input and output port of a virtual signal, which is made of each socket of the physical layer and the signal line WR. In addition, any one of the first port terminal 52*a* to the sixth port terminal 52*f* is an example of a "first input portion", and another port terminal is an example of a "second input portion".

The oscillation circuit 54 includes, for example, the crystal resonator of 32.768 kHz, divides (division ratio: 1/n) the signal generated by the crystal resonator, generates the reference signal for driving the first pointer, and outputs the generated reference signal to the control portion 56. For example, the oscillation circuit 54 generates the reference signal of 1 Hz (n=1). In addition, the oscillation circuit 54 receives the control of the control portion 56, changes the ratio of division, and generates the reference signal. For example, the oscillation circuit 54 changes a ratio of division, and generates a reference signal of 64 Hz (n=64). In addition, the reference signal is similar to a clock signal.

The first motor 57 is a stepping motor, and rotates based on the driving signal output from the control portion 56. The first pointer 58 is supported to be rotatable by the rotation shaft (not illustrated) of the first motor 57. The first pointer 58 is supported by a bearing included in the supporting body 51, and rotates with respect to the supporting body 51 in accordance with the rotation and driving of the first motor 57.

The storage portion 55 may be realized by a nonvolatile storage medium, such as a read only memory (ROM) or a flash memory. The storage portion 55 accommodates the program executed by the processor, and additionally, accommodates a driving signal correspondence table 55*a* which will be described later, a driving signal SIG_E generation table 55*b*, and the like. The driving signal correspondence table 55*a* and the driving signal SIG_E generation table 55*b* are an example of the "correspondence table".

The control portion 56 may be realized by hardware, such as a large scale integration (LSI), an application specific integrated circuit (ASIC), or a field-programmable gate array (FPGA). With reference to the driving signal correspondence table 55*a* accommodated in the storage portion 55, the control portion 56 generates the driving signal for driving the first motor 57 in accordance with the type of the port terminal of the input portion 52 into which the instruction signal is input from the main control portion 4. In addition, the control portion 56 outputs the generated driving signal to the first motor 57.

In addition, the control portion 56 outputs a driving signal at a timing of rising or falling of the signal output by the main control portion 4. The control portion 56 compares the predetermined threshold value and the signal, detects a rising engine of the signal or a falling engine of the signal based on the comparison result, and outputs the driving signal at the detection timing.

FIG. 2 is a view illustrating an example of the driving signal correspondence table 55*a* stored by the storage portion 55. As illustrated in the example, in the driving signal correspondence table 55*a*, for each type of the port terminal, an operation pattern of the pointer and the driving signal for driving the pointer by the operation pattern, correlate with each other. For example, in the first port terminal 52*a*, a "1-second handling of the pointer" which is the operation pattern and a driving signal SIG_A correlate with each other. In other words, the driving signal correspondence table 55*a* is a table in which the correspondence relationship between the operations of the first port terminal 52*a* which is the input portion and the first pointer 58, and the driving signal of the first motor 57 which drives the first pointer 58, is stored.

Next, an operation of the control portion 56 in a case where the instruction signal is input to each port terminal, will be described. In a case where the instruction signal is input to the first port terminal 52*a*, the control portion 56 generates the driving signal SIG_A for handling the first pointer 58 clockwise every 1 second by using the frequency (for example, 1 Hz) of the reference signal generated by the oscillation circuit 54. In addition, the control portion 56 outputs the generated driving signal SIG_A to the first motor 57, and rotates the first pointer 58 clockwise by 6 degrees at a time every 1 second.

In addition, in a case where the instruction signal is input to the second port terminal 52*b*, the control portion 56 generates a driving signal SIG_B for rotating the first pointer 58 clockwise by a predetermined angle (for example, 60 degrees) by using the frequency of the reference signal generated by the oscillation circuit 54. In addition, the control portion 56 outputs the generated driving signal SIG_B to the first motor 57, and rotates the first pointer 58 clockwise by a predetermined angle.

In addition, in a case where the instruction signal is input to the third port terminal 52*c*, the control portion 56 generates a driving signal SIG_C for rotating the first pointer 58 counterclockwise by a predetermined angle (for example, 60 degrees) by using the frequency of the reference signal generated by the oscillation circuit 54. In addition, the control portion 56 outputs the generated driving signal SIG_C to the first motor 57, and rotates the first pointer 58 counterclockwise by a predetermined angle.

In addition, in a case where the instruction signal is input to the fourth port terminal 52*d*, the control portion 56 generates a driving signal SIG_D for handling the first pointer 58 counterclockwise every one second by using the frequency of the reference signal generated by the oscillation circuit 54. In addition, the control portion 56 outputs the generated driving signal SIG_D to the first motor 57, and rotates the first pointer 58 counterclockwise by 6 degrees at a time every one second.

In addition, in a case where the instruction signal is input to the fifth port terminal 52*e*, the control portion 56 changes the ratio of division of the oscillation circuit 54 and generates a driving signal SIG_E for performing a predetermined continuous operation with respect to the first pointer 58 by using the frequency (for example, 64 Hz) of the reference signal which is generated by the oscillation circuit 54 of which the ratio of division is changed. The predetermined continuous operation is, for example, a series of operations of the pointer regardless of measuring the time. Since the instruction signal is input to the fifth port terminal 52*e* by the main control portion 4 so that the terminal 20 receives a mail or notifying the user of notification of a reminder or the like by using the electronic device 1, the control portion 56 may perform the series of operations of the pointer which is not related to measuring the time, and may attract attention of the user by rotating the pointer clockwise or counterclockwise by several degrees for several seconds, or by irregularly rotating the pointer. The operation of the pointer is realized by continuously or intermittently outputting a series of driving signals which vary each control content to the first motor 57. For example, the control portion 56 generates the series of driving signals with reference to the driving signal SIG_E generation table 55*b* accommodated in the storage portion 55.

In addition, in a case where the instruction signal is input to the sixth port terminal 52*f*, the control portion 56 generates a driving signal SIG_F for stopping the operation of handling the first pointer 58 clockwise every 1 second or −1 second by using the frequency of the reference signal generated by the oscillation circuit 54. In addition, the control portion 56 outputs the generated driving signal SIG_F to the first motor 57, and stops the driving of the first pointer 58.

FIG. 3 is a view illustrating an example of the driving signal SIG_E generation table 55*b* stored in the storage portion 55. As illustrated in FIG. 3, for each control item illustrating control contents, a slot number (in FIG. 3, slot No.) and the frequency correlate with each other. The slot number indicates an order of processing. In the control item, for example, a driving speed (in FIG. 3, pointer driving speed) of the pointer, the rotational direction of the pointer (in FIG. 3, the rotational direction), the rotation angle of the pointer (in FIG. 3, the rotation angle), the position at which a rotation operation of the pointer is started (in FIG. 3, the operation starting position), and the information (in FIG. 3, propriety of reciprocation) which indicates whether or not the rotational direction is reversed and the rotation is performed by a regulated rotation angle. The control items respectively correlate with each slot number, and the control portion 56 generates the driving signal in accordance with the contents of the control item for each slot number. At this time, the control portion 56 generates the driving signal by the frequency (for example, 64 Hz) correlated with the control item. In addition, the control portion 56 sequentially outputs N driving signals which respectively correlate with each of slot numbers 1 to N, for example, to the first motor 57 from an order starting from the small corresponding slot number. A set of the series of N driving signals corresponds to the driving signal SIG_E. In other words, the driving signal SIG_E generation table 55*b* is a table in which a correspondence relationship between an operation of the first pointer 58 and a driving force for driving the first motor 57 in accordance with the operation, is stored.

Figure 4:
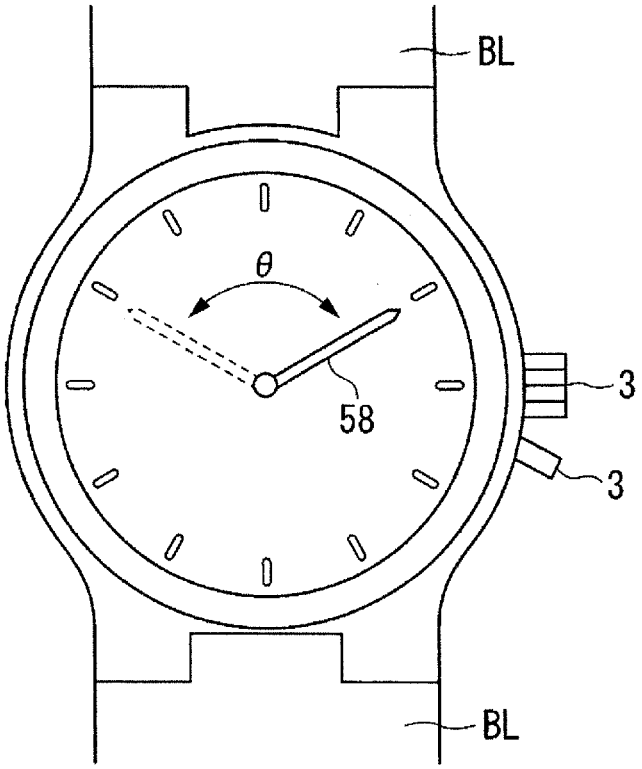
FIG. 4 is a view illustrating an example of a continuous operation of a first pointer 58 which rotates by a driving signal SIG_E.

FIG. 4 is a view illustrating an example of a continuous operation of the first pointer 58 which is driven to be rotated by the driving signal SIG_E. The driving signal SIG_E (a series of driving signals) generated by using the driving signal SIG_E generation table 55*b*, for example, is a signal for controlling the first motor 57 to reciprocate the first pointer 58 by any angle by a predetermined rotation angle width θ (for example, within a range from 10 o'clock to 2 o'clock) as shown in FIG. 4. The control portion 56 outputs the driving signal SIG_E to the first motor 57, and controls the driving of the first pointer 58 as illustrated in FIG. 4. In addition, the control portion 56 may control the first pointer 58 clockwise by an irregular driving, for example, by 30 degrees, 60 degrees, 30 degrees, . . . , as another continuous operation of the first pointer 58.

Figure 5:
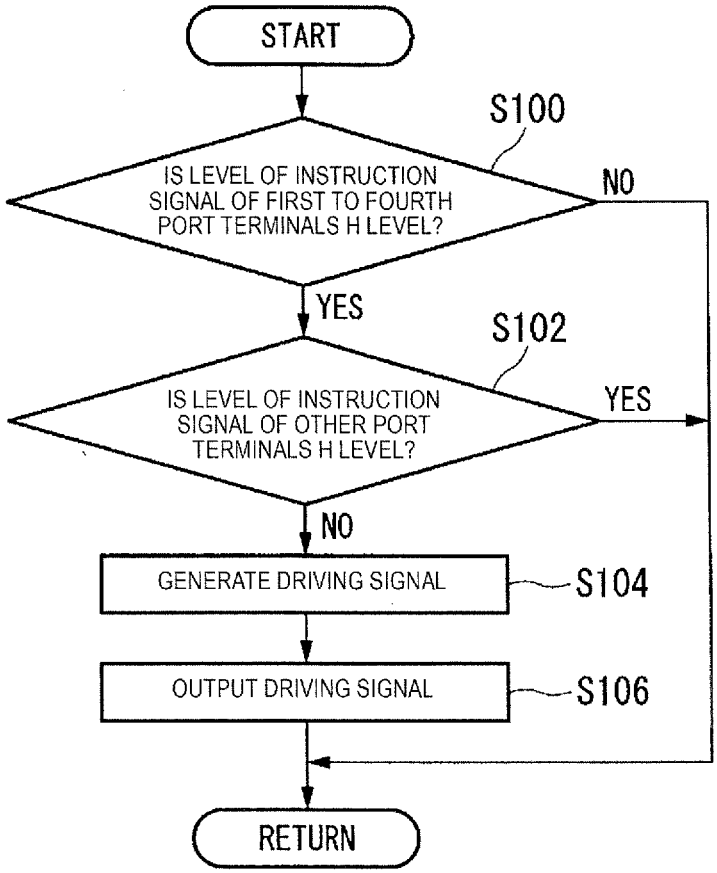
FIG. 5 is a flow chart illustrating an example of a flow of processing of a control portion 56 in the first embodiment.

FIG. 5 is flow chart illustrating an example of a flow of processing of the control portion 56 in the first embodiment. The processing of the flow chart may be, for example, repeatedly performed in a cycle of 1 Hz.

First, the control portion 56 consecutively obtains a level of the instruction signal of each of the first to the fourth port terminals. In addition, the control portion 56 obtains the level of the instruction signal in an order of the fourth port terminal from the first port terminal. Next, the control portion 56 determines whether or not a level of the instruction signal of any of the first to the fourth port terminals is the H level (step S100). In a case where a level of the instruction signal of any of the first to the fourth port terminals is the H level (step S100; YES), the control portion 56 determines whether or not a level of the instruction signal of another port terminal different from the port terminal of which is the level of the instruction signal is the H level, is the H level (step S102).

In a case where it determined that the level of the instruction signal of any of the first to the fourth port terminals is not the H level (step S100; NO), or in a case it is determined that the level of the instruction signal of two port terminals or more is the H level (step S102; YES), the control portion 56 finishes the processing of the flow chart without generating the driving signal. In addition, in a case where the control portion 56 and the main control portion 4 are provided with a seventh port terminal (not illustrated), the control portion 56, for example, may output an error signal to the main control portion 4 as a response of the command.

Meanwhile, in a case where it is determined that the level of the instruction signal only of one port terminal is the H level (step S102; NO), the control portion 56 generates a driving signal SIG which corresponds to the port terminal into which the instruction signal is input with reference to the driving signal correspondence table 55*a* (step S104).

Next, the control portion 56 outputs the generated driving signal SIG to the first motor 57 (step S106). According to this, the processing of the flow chart is finished.

Figure 6:
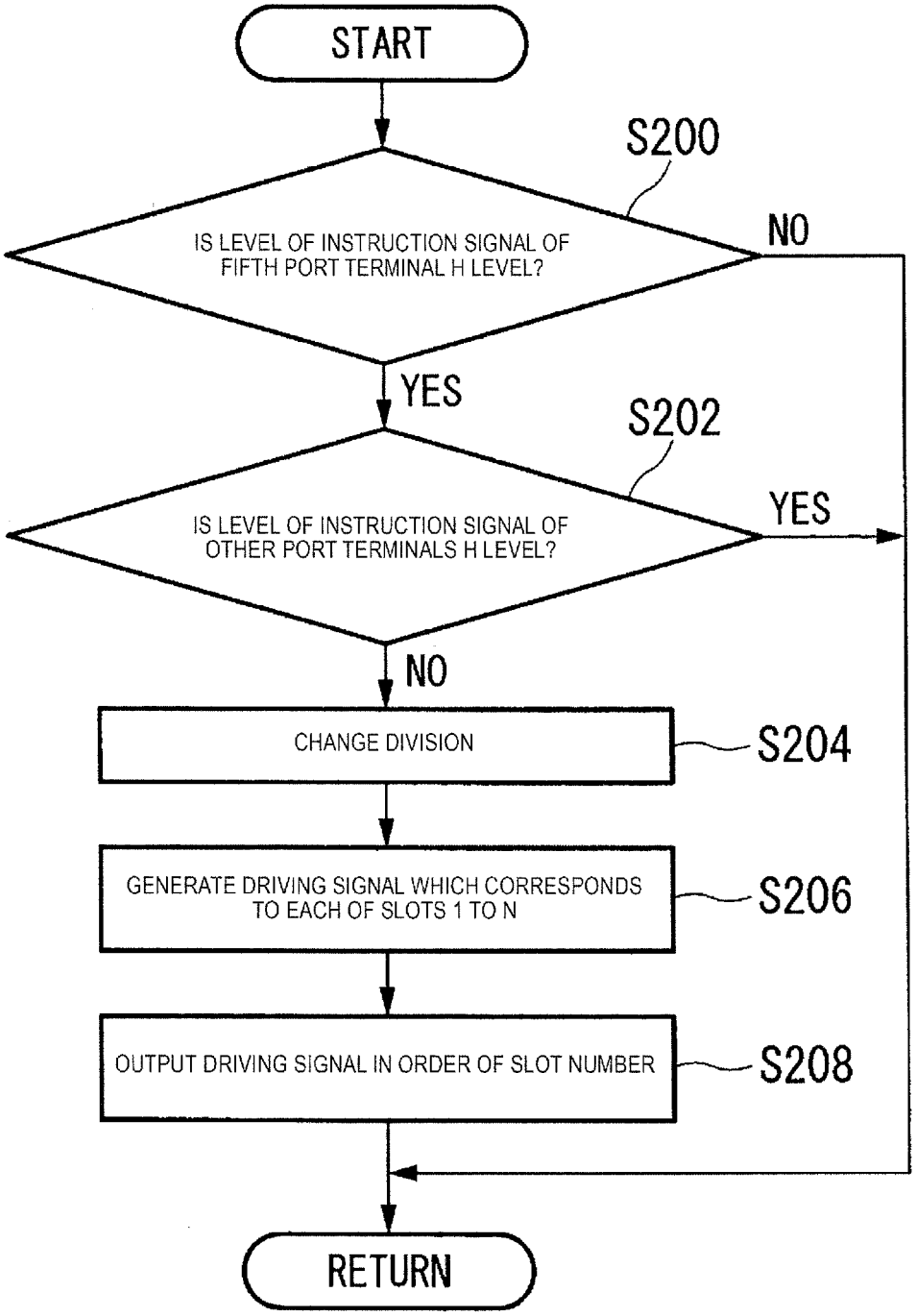
FIG. 6 is a flow chart illustrating another example of the flow of the processing of the control portion 56 in the first embodiment.

FIG. 6 is a flow chart illustrating another example of the flow of the processing of the control portion 56 in the first embodiment. The processing of the flow chart may be repeatedly performed, for example, in a cycle of 1 Hz.

First, the control portion 56 determines whether or not the level of the instruction signal of the fifth port terminal 52*e* is the H level (step S200). In a case where the level of the instruction signal of the fifth port terminal 52*e* is the H level (step S200; YES), the control portion 56 determines whether or not the level of the instruction signal of another port terminal different from the fifth port terminal 52*e* into which the instruction signal is input is the H level (step S202).

In a case where the level of the instruction signal of the fifth port terminal 52*e* is not the H level (step S200; NO), or in a case where the level of the instruction signal of the plurality of port terminals is the H level (step S202; YES), the control portion 56 finishes the processing of the flow chart.

Meanwhile, in a case where only the level of the instruction signal of the fifth port terminal 52*e* is the H level (step S202; NO), the control portion 56 changes the ratio of division of the oscillation circuit 54 (step S204). Next, the control portion 56 generates N driving signals (driving signal SIG_E) which respectively correlate with each of slot numbers 1 to N, by using the frequency of the reference signal generated by the oscillation circuit 54 of which the ratio of division is changed (step S206).

Next, the control portion 56 outputs N driving signals generated as the driving signal SIG_E to the first motor 57 in an order starting from the small slot number (or the large number) (step S208). According to this, the processing of the flow chart is finished.

In addition, in the example illustrated in FIG. 6, an example in which the driving signal is generated when the level of the signal input to the control portion 56 changes from the low level to the high level, but the control portion 56 may generate the driving force when the level of the input signal is changed from the high level to the low level.

Figure 7:
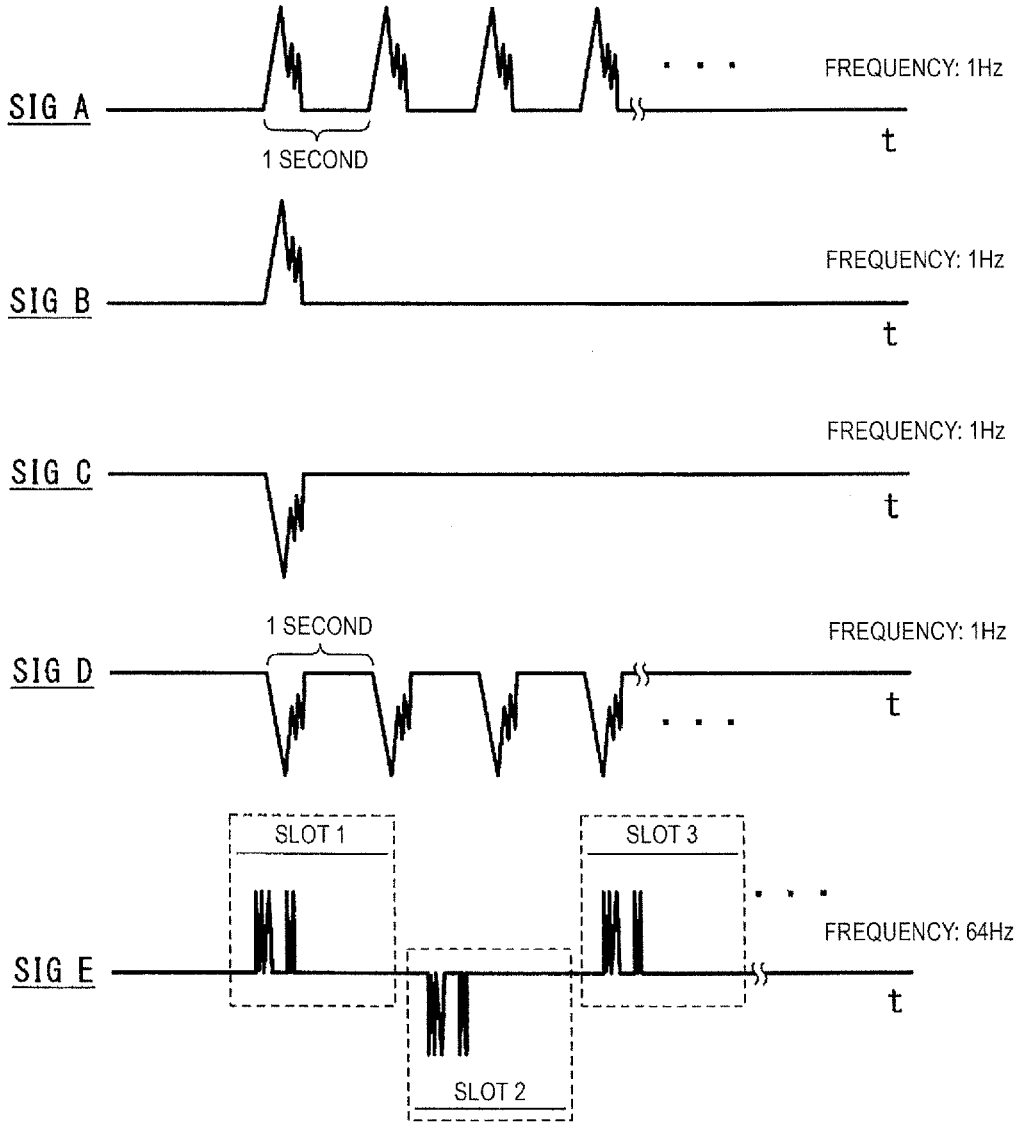
FIG. 7 is a view illustrating an example of a driving signal output by the control portion 56.

FIG. 7 is a view illustrating an example of the driving signal output by the control portion 56. In FIG. 7, a horizontal axis illustrates, for example, a time t, and a vertical axis illustrates, for example, a signal level. For example, the control portion 56 outputs a repeating triangular wave signal in a cycle of 1 Hz of frequency as the driving signal SIG_A. In addition, the control portion 56 outputs a single triangular wave signal in a cycle of 1 Hz of frequency as the driving signal SIG_B. In addition, the control portion 56 outputs a signal in which a polarity is inverted with respect to the driving signal SIG_B, as the driving signal SIG_C. In addition, the control portion 56 outputs a signal in which a polarity is inverted with respect to the driving signal SIG_A, as the driving signal SIG_D. In addition, the control portion 56 outputs the driving signal SIG_E of which the driving signals generated in accordance with the control contents for each slot are continuous to each other. In addition, the control portion 56 outputs the driving signal SIG_F as a signal which is obtained by making the signal level of the driving signal SIG_A or the driving signal SIG_D into the L level (for example, 0) during the entire period of time.

According to the above-described first embodiment, by providing the input portion 52 including the plurality of port terminals into which the instruction signal is input from the main control portion 4, and the control portion 56 which outputs the driving signal that corresponds to the type of the port terminal into which the instruction signal is input, to the first motor 57, in a case where the instruction signal is input in any of the plural port terminals, it is possible to make the instruction signal output to the control portion 56 included in the first pointer driving motor unit 5 from the main control portion 4, into a simple signal, and in order to determine the port terminal (signal line WR) of an output destination of the instruction signal in accordance with the information from the terminal 20, it is possible to easily control the driving of the pointer of the time piece by the stepping motor.

In addition, according to the first embodiment, the program which is used in the processor of the main control portion 4 can be realized by a simple program which determines the port terminal (signal line WR) of the instruction signal in accordance with the information sent by the terminal 20, and outputs the instruction signal to the first pointer driving motor unit 5 via the signal line WR and the port terminal. Therefore, it is not necessary for a creator of the program to interpret characteristics of the motor or a generation method of the driving signal, and for example, and it is sufficient only to create a simple program in which the main control portion 4 only outputs the instruction signal to any of the first port terminal 52*a* to the sixth port terminal 52*f*. As a result, according to the first embodiment, it is possible to reduce a load in creating a program.

Second Embodiment

Hereinafter, an electronic device 1A including the pointer driving motor unit in a second embodiment will be described. The electronic device 1A including the pointer driving motor unit in a second embodiment, is different from the electronic device 1 in the first embodiment in a point that the plurality of units are provided. Therefore, the description will focus on the related different points, and common parts will be omitted in the description.

Figure 8:
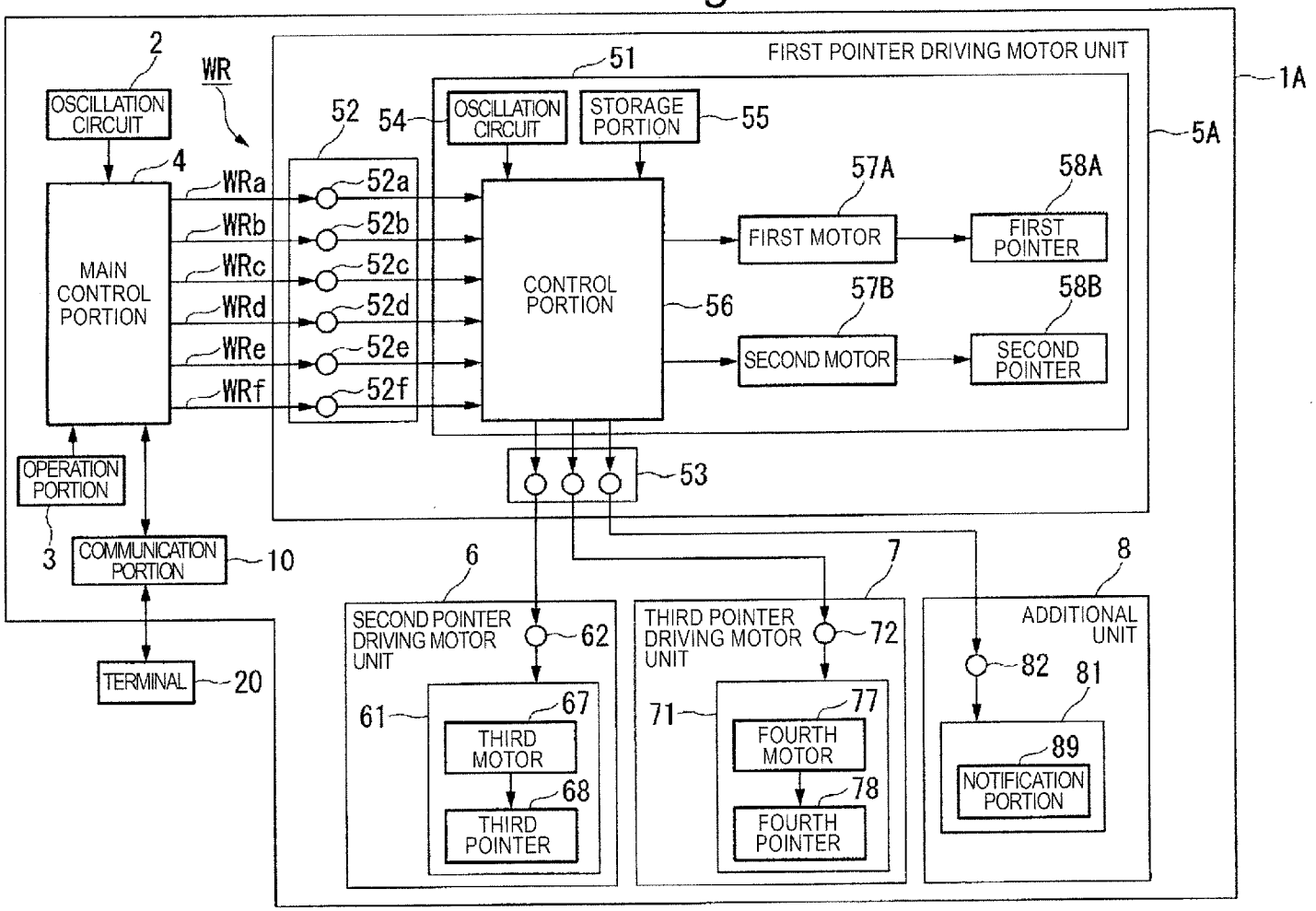
FIG. 8 is a configuration view illustrating a configuration of an electronic device 1A including a pointer driving motor unit in a second embodiment.

FIG. 8 is a configuration view illustrating a configuration of the electronic device 1A including the pointer driving motor unit in the second embodiment. The electronic device 1A in the second embodiment includes the above-described oscillation circuit 2, the operation portion 3, the main control portion 4, and the communication portion 10, and further includes a first pointer driving motor unit 5A, a second pointer driving motor unit 6, a third pointer driving motor unit 7, and an additional unit 8.

The first pointer driving motor unit 5A includes, for example, the supporting body 51, the input portion 52, an output portion 53, the oscillation circuit 54, the storage portion 55, the control portion 56, a first motor 57A, a second motor 57B, a first pointer 58A, and a second pointer 58B. In addition, there is also a case where an aspect in which the first pointer 58A and the second pointer 58B are attached to the outside of the first pointer driving motor unit 5A is achieved.

The supporting body 51 includes the substrate, the ground board which becomes the base, the receiving board which suppresses a component disposed on the ground board from the opposite side, another case portion, the bearing to which rotation shafts of the first motor 57A and the second motor 57B are bonded, and the like. The substrate is disposed on the ground board, and on the substrate, the wiring, the input portion 52, the output portion 53, the oscillation circuit 54, the storage portion 55, the control portion 56, the first motor 57A, the second motor 57B, a wheel train which is a gear train that transmits the torque from the motor, and the like, are disposed. A unit is assembled by fastening the components using the receiving board. In addition, on the ground board, an electrode which becomes a connection terminal that will be described later is disposed, and the electrode plays a role of making an electronic component on the inside and the outside of the unit electrically conducted with each other.

The output portion 53 is a connection terminal which connects the second pointer driving motor unit 6, the third pointer driving motor unit 7, and the additional unit 8 to each other. The signal output by the control portion 56 is output to each unit via the output portion 53.

The first motor 57A and the second motor 57B are, for example, stepping motors. The first motor 57A and the second motor 57B rotate based on the driving signal output from the control portion 56. The first pointer 58A is supported by the bearing included in the supporting body 51, and rotates with respect to the supporting body 51 according to the rotation and driving of the first motor 57A. In addition, the second pointer 58B is supported by the bearing included in the supporting body 51, and rotates with respect to the supporting body 51 in accordance with the rotation and driving of the second motor 57B. For example, the first pointer 58A is a minute hand, and the second pointer 58B is an hour hand.

The second pointer driving motor unit 6 includes a supporting body 61, an input portion 62, a third motor 67, and a third pointer 68. The supporting body 61 includes the substrate, the ground board which becomes the base, the receiving board which suppresses a component disposed on the ground board from the opposite side, another case portion, the bearing to which a rotation shaft of the third motor 67 is bonded, and the like. The substrate is disposed on the ground board, and on the substrate, the wiring, the input portion 62, the third motor 67, a wheel train which is a gear train that transmits the torque from the motor, and the like, are disposed. A unit is assembled by fastening the components using the receiving board. In addition, on the ground board, an electrode which becomes a connection terminal that will be described later is disposed, and the electrode plays a role of making an electronic component on the inside and the outside of the unit electrically conducted with each other.

The third motor 67 is, for example, a stepping motor. The third motor 67 rotates based on the driving signal output from the control portion 56. The third pointer 68 is supported by the bearing included in the supporting body 61, and rotates with respect to the supporting body 61 in accordance with the rotation and driving of the third motor 67. The third pointer 68 is, for example, a second hand.

The third pointer driving motor unit 7 includes a supporting body 71, an input portion 72, a fourth motor 77, and a fourth pointer 78. The supporting body 71 includes the substrate, the ground board which becomes the base, the receiving board which suppresses a component disposed on the ground board from the opposite side, another case portion, the bearing to which a rotation shaft of the fourth motor 77 is bonded, and the like. The substrate is disposed on the ground board, and on the substrate, the wiring, the input portion 72, the fourth motor 77, a wheel train which is a gear train that transmits the torque from the motor, and the like, are disposed. A unit is assembled by fastening the components using the receiving board. In addition, on the ground board, an electrode which becomes a connection terminal that will be described later is disposed, and the electrode plays a role of making an electronic component on the inside and the outside of the unit electrically conducted with each other.

The fourth motor 77 is, for example, a stepping motor. The fourth motor 77 rotates based on the driving signal output from the control portion 56. The fourth pointer 78 is supported by the bearing included in a supporting body 71, and rotates with respect to the supporting body 71 in accordance with the rotation and driving of the fourth motor 77. For example, the fourth pointer 78 is a timing measuring display needle of a chronograph function or a display needle indicating various types of information sent from the terminal 20.

The additional unit 8 includes a supporting body 81, an input portion 82, and a notification portion 89. The supporting body 81 includes, for example, the case and the substrate. For example, the supporting body 81 includes the substrate, the ground board which becomes the base, the receiving board which suppresses a component disposed on the ground board from the opposite side, another case portion, and the like. The substrate is disposed on the ground board, and on the substrate, the wiring, the input portion 82, the notification portion 89, and the like, are disposed. A unit is assembled by fastening the components using the receiving board. In addition, on the ground board, an electrode which becomes a connection terminal that will be described later is disposed, and the electrode plays a role of making an electronic component on the inside and the outside of the unit electrically conducted with each other.

The notification portion 89 is, for example, a buzzer, and notifies of a sound in accordance with the driving signal output from the control portion 56. In addition, the notification portion 89 may be a lamp or an oscillation element.

For example, the first pointer driving motor unit 5 indicates "hour" and "minute", and the second pointer driving motor unit 6 indicates "second". The third pointer driving motor unit 7 indicates a progress of time measuring or the result of time measuring by the chronograph function. The additional unit 8 notifies of an alarm sound at a time set by the user, or notifies of an alarm sound receiving the control of the control portion 56. In addition, the operation of each of the above-described units is an example, and the present invention is not limited thereto.

The main control portion 4 controls the corresponding signal line WR in accordance with the command received from the terminal 20. At this time, the main control portion 4 changes the signal parameter of the instruction signal which transmits the signal line WR, and assigns a target (control target) controlled by the control portion 56 among each motor of the first pointer driving motor unit 5A, the second pointer driving motor unit 6, and the third pointer driving motor unit 7, and the notification portion 89 of the additional unit 8. The main control portion 4 assigns the number of control targets, for example, in accordance with the number of pulses of the instruction signal which is output within a predetermined time.

The control portion 56 determines the control target based on the signal parameter of the instruction signal which transmits the signal line WR when the main control portion 4 controls the signal line WR.

Figure 9:
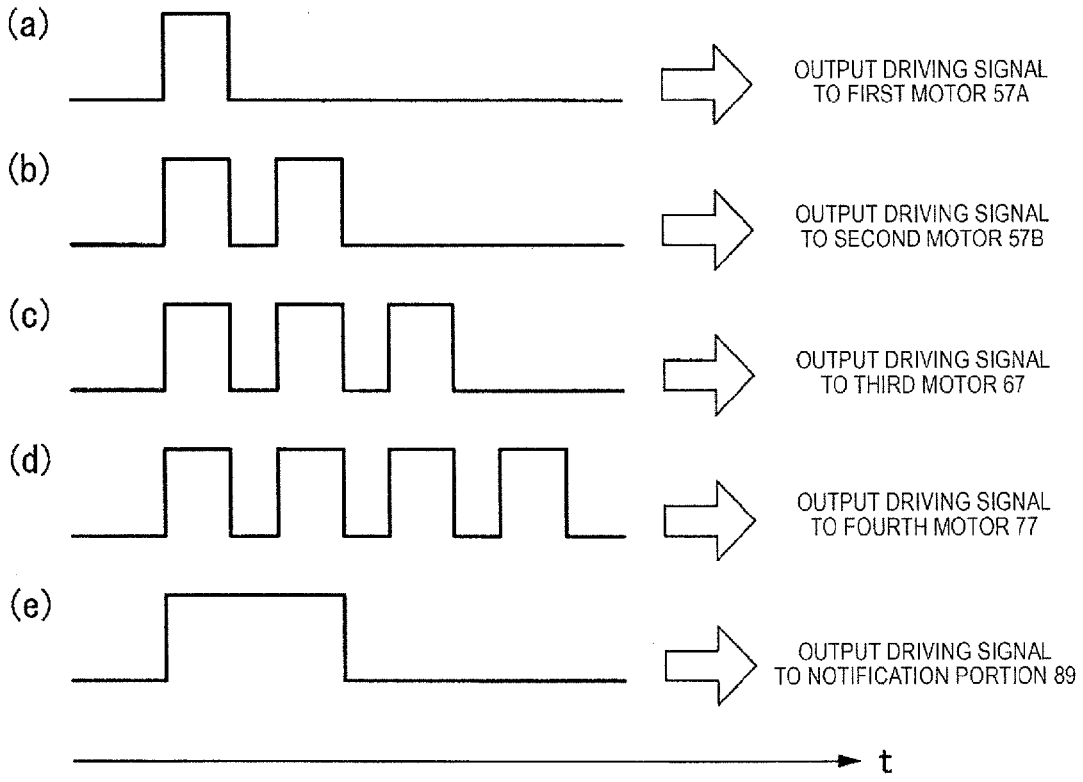
FIG. 9 is a view schematically illustrating an example of a determination method of a control target by the control portion 56.

FIG. 9 is a view schematically illustrating an example of a determination method of the control target by the control portion 56. In FIG. 9, a horizontal axis illustrates, for example, a time t, and a vertical axis illustrates, for example, a signal level. As illustrated in FIG. 9, for example, in a case where the number of pulses of the instruction signal which is output within the predetermined time is 1, the control portion 56 drives the first motor 57A of the first pointer driving motor unit 5A, and in a case where the number of pulses of the instruction signal is 2, the control portion 56 drives the second motor 57B of the first pointer driving motor unit 5A. In addition, in a case where the number of pulses of the instruction signal is 3, the control portion 56 drives the third motor 67 of the second pointer driving motor unit 6, and in a case where the number of pulses of the instruction signal is 4, the control portion 56 drives the fourth motor 77 of the third pointer driving motor unit 7. In addition, in a case where the width of the pulse of the instruction signal is equal to or greater than regulation (for example, 2 times), the control portion 56 drives the notification portion 89.

Figure 10:
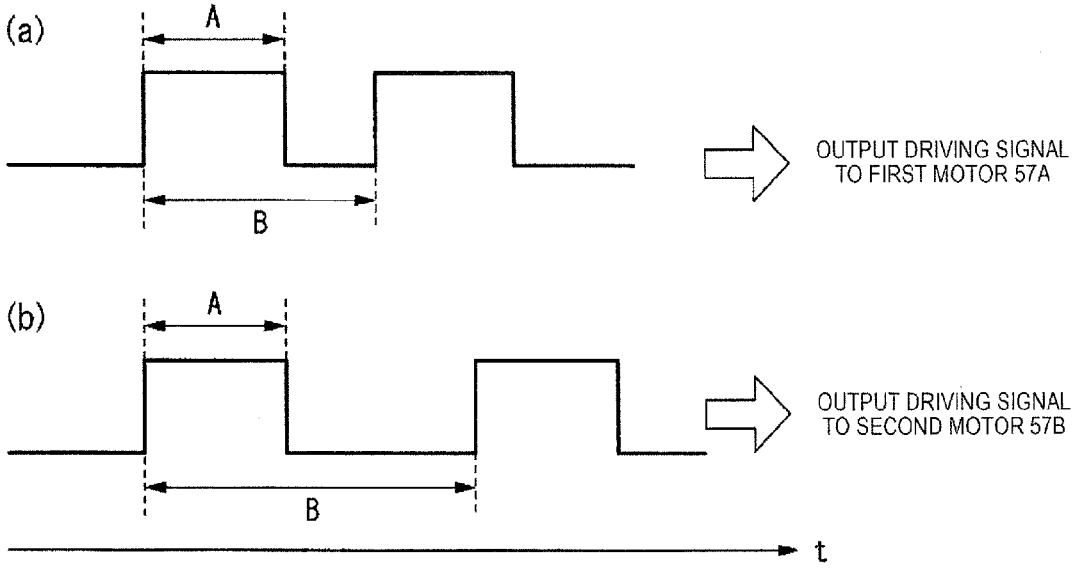
FIG. 10 is a view schematically illustrating another example of the determination method of the control target by the control portion 56.

In addition, an assignment method of the control target (various motors, the notification portion 89) is an example, and the control target may be assigned by the frequency or the duty ratio. FIG. 10 is a view schematically illustrating another example of the determination method of the control target by the control portion 56. In FIG. 10, a horizontal axis illustrates, for example, a time t, and a vertical axis illustrates, for example, a signal level. As illustrated in FIG. 10, for example, in a case where the duty ratio (=A/B) is equal to or greater than a predetermined value (for example, 0.5), the control portion 56 may drive the first motor 57A by outputting the driving signal to the first motor 57A, and in a case where the duty ratio (=A/B) is less than the predetermined value, the control portion 56 may drive the second motor 57B by outputting the driving signal to the second motor 57B.

In addition, in the above-described example, an example in which a single control target is assigned in accordance with the instruction signal is described, but the present invention is not limited thereto. For example, in a case where the instruction signal is a signal which indicates the predetermined number of bits (for example 3 bits), rising of pulse is detected for each cycle using a rising time of the pulse of a tip head as a reference, and the number of control targets may be assigned by binary digits in which the rising of the pulse is "1" and the falling is "0". For example, in a case where the binary number represented by the instruction signal is "011", the control portion 56 drives 3 control targets at the same time.

In a case where the plurality of control targets are assigned at the same time, the control portion 56 may output the driving signal to all of the assigned control targets. For example, in a case where the first motor 57A, the second motor 57B, and the third motor 67 are assigned by the instruction signal input to the first port terminal 52*a*, the control portion 56 outputs the driving signal SIG_A which corresponds to the first port terminal 52*a* to the 3 control targets. According to this, the electronic device 1 drives the first pointer 58A, the second pointer 58B, and the third pointer 68 by the same operation.

Figure 11:
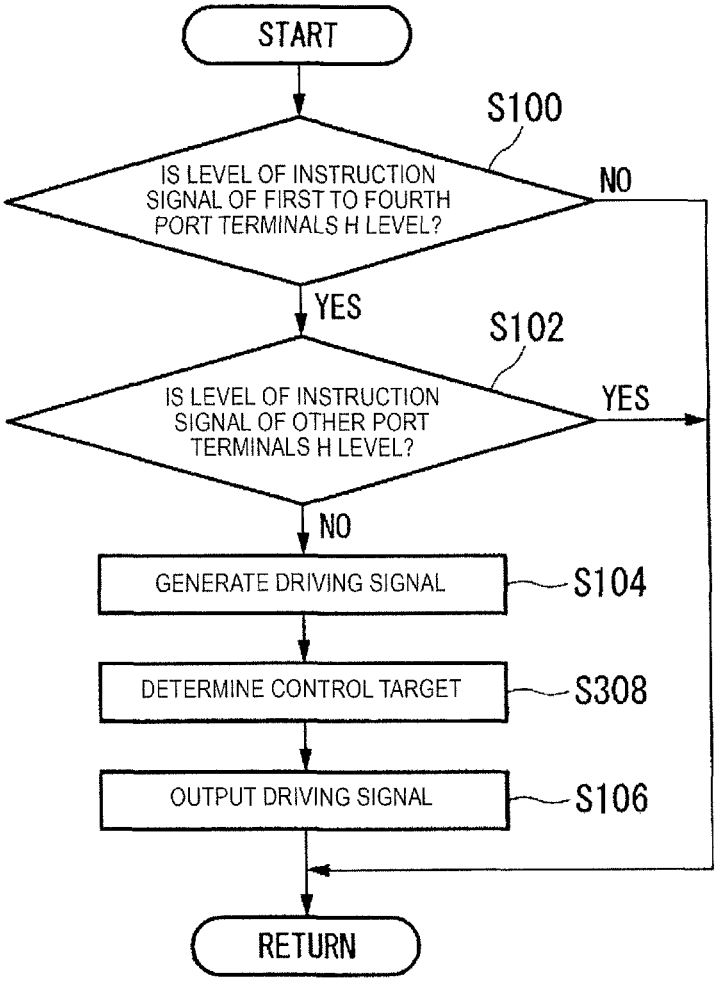
FIG. 11 is a flow chart illustrating an example of a flow of processing of the control portion 56 in a second embodiment.

FIG. 11 is a flow chart illustrating an example of a flow of processing of the control portion 56 in the second embodiment. The processing of the flow chart may be repeatedly performed, for example, in a cycle of 1 Hz.

First, the control portion 56 may perform processing similar to processing from step S100 to step S104 of the flow chart illustrated in FIG. 5 described above. Next, the control portion 56 determines a control target which outputs the generated driving signal SIG based on the signal parameter of the instruction signal (step S308). Next, the control portion 56 performs processing similar to processing of step S106 of the flow chart illustrated in FIG. 5 described above. According to this, the processing of the flow chart is finished.

Figure 12:
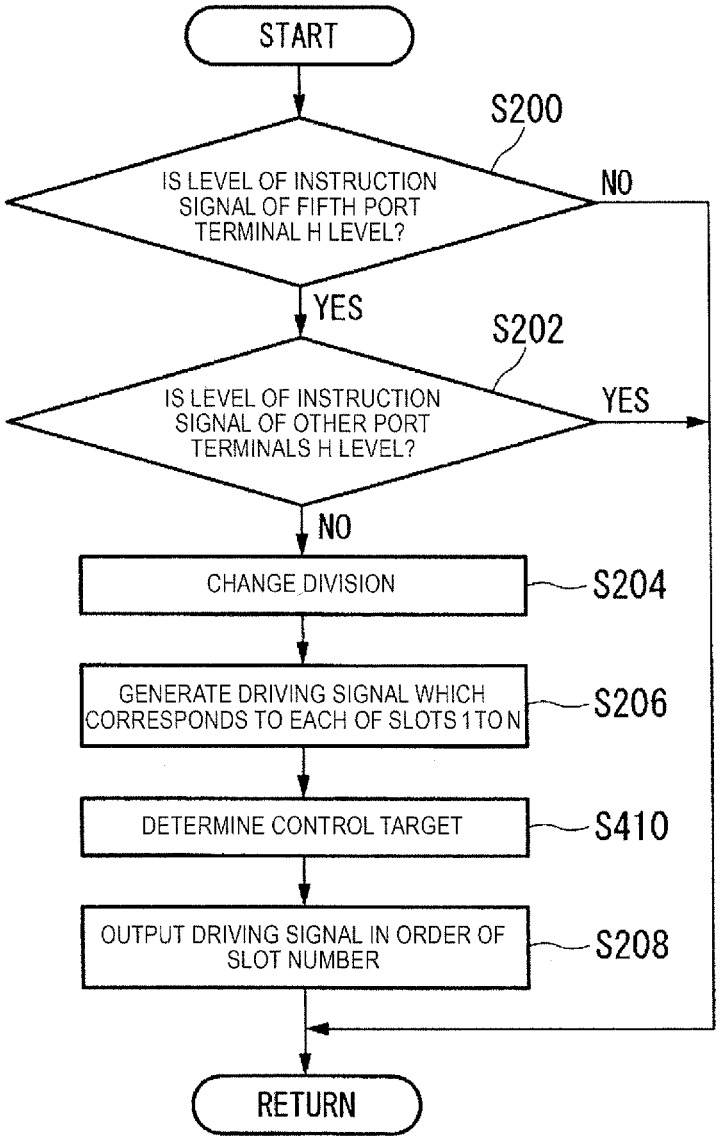
FIG. 12 is a flow chart illustrating another example of the flow of the processing of the control portion 56 in the second embodiment.

FIG. 12 is a flow chart illustrating another example of the flow of the processing of the control portion 56 in the second embodiment. The processing of the flow chart may be repeatedly performed, for example, in a cycle of 1 Hz.

First, the control portion 56 may perform processing similar to processing from step S200 to step S206 of the flow chart illustrated in FIG. 6 described above. Next, the control portion 56 determines a control target which outputs the generated driving signal SIG_E based on the signal parameter of the instruction signal (step S410). Next, the control portion 56 performs processing similar to processing of step S208 of the flow chart illustrated in FIG. 6 described above. According to this, the processing of the flow chart is finished.

In addition, in the example illustrated in FIGS. 11 and 12, an example in which the driving signal is generated when the level of the signal input to the control portion 56 is changed from the low level to the high level is described, but the control portion 56 may generate the driving signal when the level of the input signal is changed from the high level to the low level.

In addition, in a case where the level of the instruction signal of the first port terminal 52*a* is the H level, the control portion 56 outputs the driving signal SIG_A to the third motor 67 of the second pointer driving motor unit 6, and controls the third pointer 68 to handle to the pointer for 1 second. At this time, the control portion 56 controls the third pointer 68, counts the number of seconds based on the reference signal, and may control the first pointer 58A of the first pointer driving motor unit 5A when 60 seconds have passed to drive the pointer for 1 second.

According to the above-described second embodiment, similar to the first embodiment, the instruction signal output to the control portion 56 included in the first pointer driving motor unit 5A from the main control portion 4 can be a simple signal, the port terminal (signal line WR) of the output destination of the instruction signal is determined in accordance with the information from the terminal 20, and thus, it is possible to easily control the driving of the pointer of the time piece by the stepping motor.

In addition, the according to the second embodiment, in accordance with the instruction signal output from the main control portion 4, the control portion 56 can drive the control target (the motor or the notification portion) of other units connected to the first pointer driving motor unit 5A. As a result, according to the second embodiment, it is possible to satisfy the reduction of the size of the unit, and ensuring of controllability in a case where the unit is complicated, at the same time.

In addition, according to the second embodiment, in a case where the electronic device 1 is provided with the plurality of units, since the control portion 56 generates and outputs the driving signal for each unit, it is possible to reduce a processing load of the main control portion 4 which performs communication processing with the terminal 20.

(Modification Example of Second Embodiment)

Hereinafter, a modification example of the second embodiment will be described. In the modification example of the second embodiment, in accordance with the port terminal of which the level of the instruction signal is controlled to the H level, the control target to which the driving signal is output in advance is determined. The correspondence relationship between each port terminal and the control target may be stored as the driving signal correspondence table 55*a* to the storage portion 55 in advance, or may be set based on the command sent by the terminal 20.

The control portion 56 determines the unit of the output destination of the generated driving signal with reference to the driving signal correspondence table 55*a* accommodated in the storage portion 55.

FIG. 13 is a view illustrating an example of the driving signal correspondence table 55*a* stored by the storage portion 55 in the second embodiment. As illustrated in FIG. 13, in the driving signal correspondence table 55*a* of the second embodiment, for each type of the port terminal, the operation pattern of the pointer, the driving signal, and the output destination of the driving signal correlate with each other. For example, in the first port terminal 52*a*, "1-second pointer handling" which is the operation pattern, the driving signal SIG_A, and "first pointer driving motor unit" which is the output destination, correlate with each other.

Next, an operation of the control portion 56 in a case where the instruction signal is input to each port terminal, will be described. As illustrated in FIG. 13, the driving signals SIG_A and SIG_B are output to the control target (the first motor 57A and the second motor 57B) provided in the first pointer driving motor unit 5A, the driving signal SIG_C is output to the control target (third motor 67) provided in the second pointer driving motor unit 6, the driving signal SIG_D is output to the control target (fourth motor 77) provided in the third pointer driving motor unit 7, the driving signal SIG_E is output to the control target (notification portion 89) provided in the additional unit 8, and the driving signal SIG_F is output to the control target (the first motor 57A and the second motor 57B) provided in the first pointer driving motor unit 5A. The notification portion 89 generates the alarm sound in accordance with the driving signal SIG_E, and notifies the user of the reception of the mail by the terminal 20 or the presence or the absence of the reminder.

In addition, the control portion 56 may also output the same driving signal with respect to the other units, in addition to the unit determined with reference to the driving signal correspondence table 55*a*. For example, the control portion 56 outputs the driving signals SIG_A and the SIG_B to the control target (the first motor 57A and the second motor 57B) provided in the first pointer driving motor unit 5A, and may output the driving signals SIG_A and the SIG_B to the control target (third motor 67) provided in the second pointer driving motor unit 6, and the control target (fourth motor 77) provided in the third pointer driving motor unit 7.

Third Embodiment

Hereinafter, an electronic device 1B including the pointer driving motor unit in a third embodiment will be described. The functional portions having functions which are the same as those of the electronic device 1 including the pointer driving motor unit in the third embodiment, will be given the same reference numerals, and the description thereof will be omitted.

Figure 14:
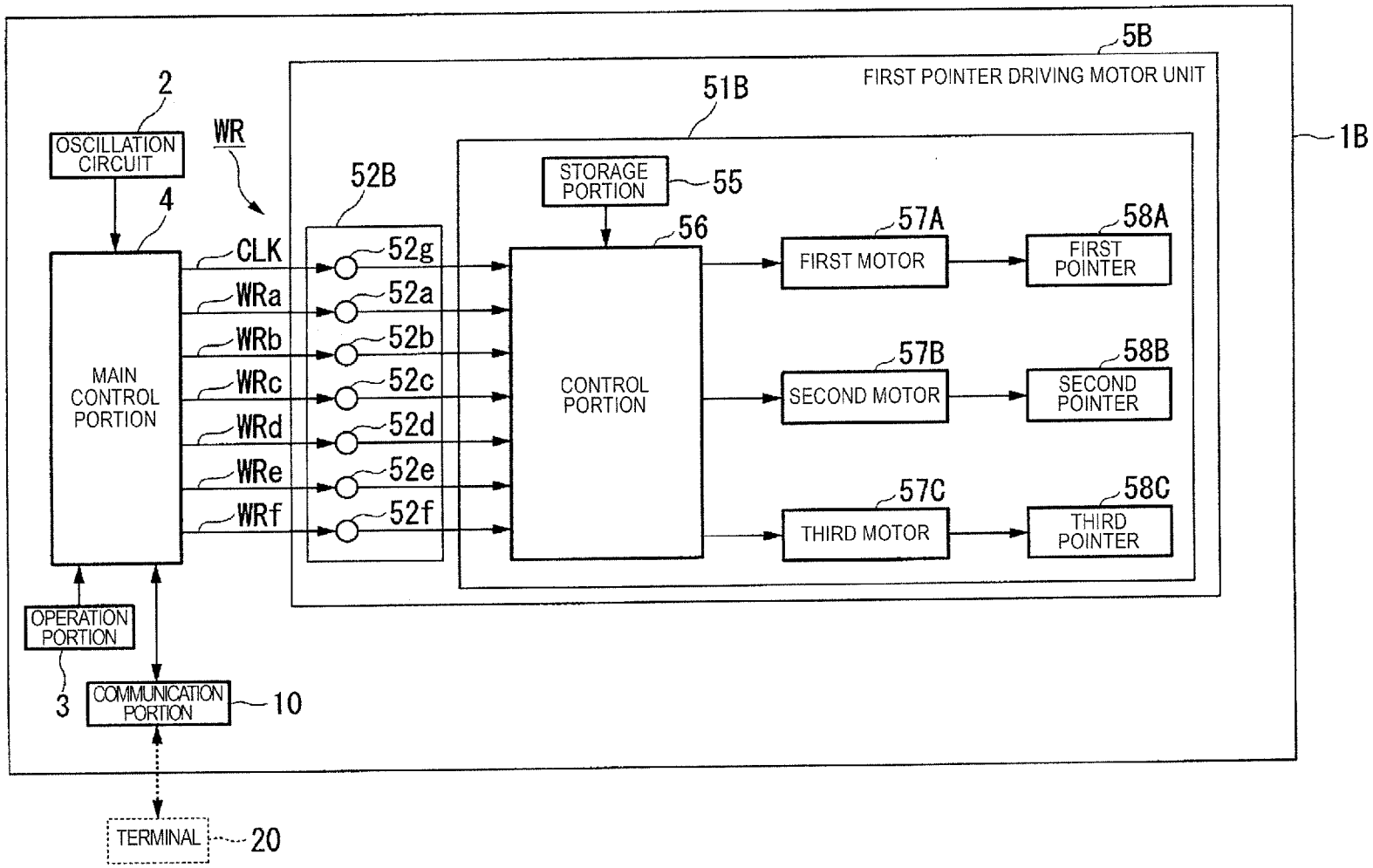
FIG. 14 is a configuration view illustrating a configuration of an electronic device 1B including a pointer driving motor unit in a third embodiment.

FIG. 14 is a configuration view illustrating a configuration of the electronic device 1B including the pointer driving motor unit in the third embodiment. As illustrated in FIG. 14, the electronic device 1B in the third embodiment includes the oscillation circuit 2, the operation portion 3, the main control portion 4, the communication portion 10, and a first pointer driving motor unit 5B. In addition, the electronic device 1B may be provided with the output portion 53 similar to the electronic device 1A of the second embodiment.

A supporting body 51B includes the substrate, the ground board which becomes the base, the receiving board which suppresses a component disposed on the ground board from the opposite side, another case portion, the bearing to which a rotation shaft of the motor (the first motor 57A, the second motor 57B, and a third motor 57C) is bonded, and the like. The substrate is disposed on the ground board, and on the substrate, the wiring, an input portion 52B, the storage portion 55, the control portion 56, the first motor 57A, the second motor 57B, the third motor 57C, a wheel train which is a gear train that transmits the torque from the motor, and the like, are disposed. A unit is assembled by fastening the components using the receiving board. In addition, on the ground board, an electrode which becomes a connection terminal is disposed, and the electrode plays a role of making an electronic component on the inside and the outside of the unit electrically conducted with each other.

The input portion 52B is a communication interface of the control portion 56. The input portion 52B includes a seventh port terminal 52*g* connected to a signal line CLK, the first port terminal 52*a* (first input portion) which is connected to the signal line WRa, the second port terminal 52*b* (second input portion) which is connected to the signal line WRb, the third port terminal 52*c* (third input portion) which is connected to the signal line WRc, the fourth port terminal 52*d* (fourth input portion) which is connected to the signal line WRd, the fifth port terminal 52*e* (fifth input portion) which is connected to the signal line WRe, and the sixth port terminal 52*f* (sixth input portion) which is connected to the signal line WRf. In addition, each port terminal of the input portion 52B may be provided as a socket on the physical layer on the inside of the control portion 56, or may be an input and output port of a virtual signal made of each socket of the physical layer and the signal line WR. In addition, the signal line CLK is a clock output from the main control portion 4. In other words, in the embodiment, as illustrated in FIG. 14, the first pointer driving motor unit 5B is not provided with the oscillation circuit, and the clock which is output by the main control portion 4 is obtained and used.

The first motor 57A, the second motor 57B, and the third motor 57C are, for example, stepping motors. The first motor 57A, the second motor 57B, and the third motor 57C rotate based on the driving signal output from the control portion 56. The first pointer 58A is supported by the bearing included in the supporting body 51B, and rotates with respect to the supporting body 51B in accordance with the rotation and driving of the first motor 57A. The second pointer 58B is supported by the bearing included in the supporting body 51B, and rotates with respect to the supporting body 51B in accordance with the rotation and driving of the second motor 57B. In addition, a third pointer 58C is supported by the bearing included in the supporting body 51B, and rotates with respect to the supporting body 51B in accordance with the rotation and driving of the third motor 57C. For example, the first pointer 58A is a second hand, the second pointer 58B is a minute hand, and the third pointer 58C is an hour hand. In addition, there is also a case where an aspect in which the first pointer 58A, the second pointer 58B, and the third pointer 58C are attached to the outside of the first pointer driving motor unit 5B is achieved.

The control portion 56 determines the unit of the output destination of the generated driving signal, for example, with reference to the driving signal correspondence table 55*a* accommodated in the storage portion 55.

In addition, in the embodiment, the first pointer driving motor unit 5B is not provided with the oscillation circuit, and receives the supply of the clock signal from the main control portion 4.

FIG. 15 is a view illustrating an example of the driving signal correspondence table 55*a* stored by the storage portion 55 in the third embodiment. As illustrated in FIG. 15, in the driving signal correspondence table 55*a*, for each type of the port terminal, the operation pattern of the pointer, the driving signal, and the output destination of the driving signal correlate with each other. For example, in the first port terminal 52*a*, "1 normal rotation of the first pointer" which is the operation pattern, the driving signal SIG_A, and the first motor which is the output destination, correlate with each other, and in the fourth port terminal 52*d*, "1 reverse rotation of the second pointer" which is the operation pattern, the driving signal SIG_D, and the second motor which is the output destination, correlate with each other.

Next, an operation of the control portion 56 in a case where the instruction signal is input to each port terminal, will be described.

As illustrated in FIG. 15, the driving signals SIG_A and SIG_B are output to the first motor 57A which is the control target. The driving signals SIG_C and SIG_D are output to the second motor 57B which is the control target. The driving signals SIG_E and SIG_F are output to the third motor 57C which is the control target.

In this manner, in the first pointer driving motor unit 5B of the embodiment, the input portion 52B includes the first port terminal 52*a* (first input portion) into which the signal which normally rotates (first operation) the first motor 57A is input, the second port terminal 52*b* (second input portion) into which the signal which reversely rotates (second operation) the first motor 57A is input, the third port terminal 52*c* (third input portion) into which the signal which normally rotates (third operation) the second motor 57B is input, the fourth port terminal 52*d* (fourth input portion) into which the signal which reversely rotates (fourth operation) the second motor 57B is input, the fifth port terminal 52*e* (fifth input portion) into which the signal which normally rotates (fifth operation) the third motor 57C is input, and the sixth port terminal 52*f* (sixth input portion) into which the signal of reversely rotates (sixth operation) the third motor 57C is input. Furthermore, the input portion 52B (first input portion) is provided with the seventh port terminal 52*g* into which the clock is input.

In addition, the control portion 56 generates the driving signal in accordance with the signal output by the main control portion 4, and outputs the generated driving signal to the corresponding first motor 57A to the third motor 57C. For example, in a case the main control portion 4 changes the signal line WRb from the low level to the high level, the control portion 56 drives the first motor 57A to reversely rotate. In addition, the driving signal which normally rotates the first motor 57A is a first driving signal, and the driving signal which reversely rotates the first motor 57A is a second driving signal. The driving signal which normally rotates the second motor 57B is a third driving signal, and the driving signal which reversely rotates the second motor 57B is a fourth driving signal. The driving signal which normally rotates the third motor 57C is a fifth driving signal, and the driving signal which reversely rotates the third motor 57C is a sixth driving signal. In addition, the instruction signal which normally rotates the first motor 57A is a first instruction signal, and the instruction signal which reversely rotates the first motor 57A is a second instruction signal. The instruction signal which normally rotates the second motor 57B is a third instruction signal, and the instruction signal which reversely rotates the second motor 57B is a second instruction signal. The instruction signal which normally rotates the third motor 57C is a fifth instruction signal, and the instruction signal which reversely rotates the third motor 57C is a sixth instruction signal. The storage portion 55 stores the correspondence relationship between each of the input portions 52 (the n-th input portion; n is an integral number which is 1 to 6), each driving signal, and the output destination, as illustrated in FIG. 15.

Next, an example of the relationship between the clock input to the control portion 56 and the driving signal, will be described.

Figure 16:
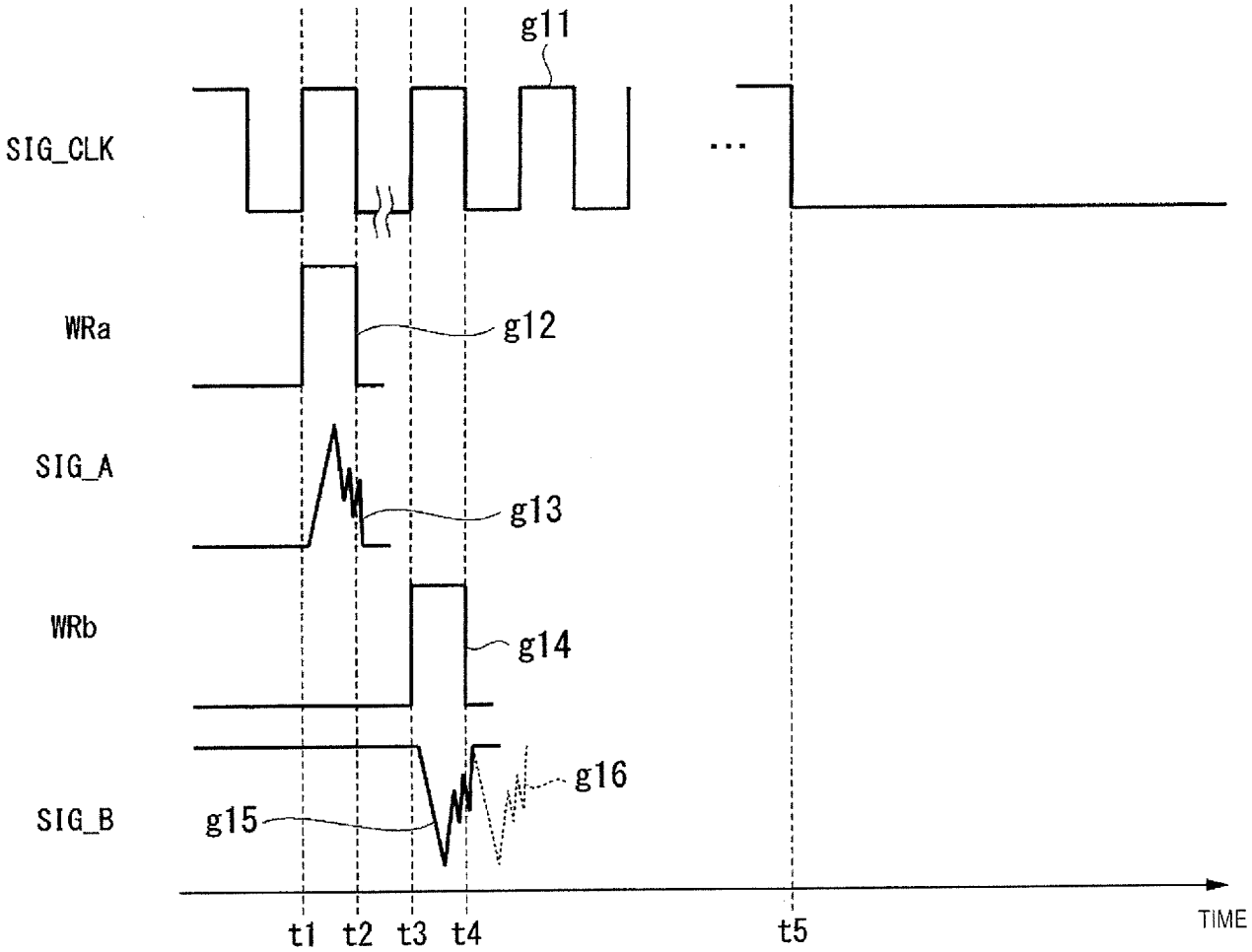
FIG. 16 is a view illustrating an example of a relationship between a clock input to the control portion 56 according to the third embodiment and the driving signal.

FIG. 16 is a view illustrating an example of the relationship between the clock input to the control portion 56 according to the embodiment and the driving signal. In FIG. 16, a horizontal axis illustrates a time, and a vertical axis illustrates a level of signal. In addition, a waveform g11 is a waveform of a clock signal SIG_CLK output by the main control portion 4. A waveform g12 is a waveform of the signal output to the signal line WRa by the main control portion 4, and a waveform g13 is a waveform of the driving signal SIG_A. A waveform g14 is a waveform of the signal output to the signal line WRb by the main control portion 4, and a waveform g15 is a waveform of the driving signal SIG_B.

At the time of a time t1, similar to the waveform g11 and the waveform g12, at the timing of rising of the clock signal SIG_CLK, the control portion 56 compares the level of the signal line output to the signal line WRa by the main control portion 4 with the predetermined threshold value, and detects that the level of the signal is changed from the low level to the high level. In addition, at the time of the time t1, similar to the waveform g13, after the main control portion 4 performs the determination, the control portion 56 outputs the driving signal SIG_A to the first motor 57A. In addition, in the example illustrated in FIG. 16, an example in which the driving signal SIG_A is output between the time t1 to time t2 is illustrated, but the driving signal SIG_A may be a signal which drives the first pointer 58A by a predetermined angle. In addition, an example in which the number of normal rotations is 1 is illustrated in the example illustrated in FIG. 15, but not being limited thereto, the number of normal rotations may be the number which corresponds to use.

At the time of a time t3, similar to the waveform g11 and the waveform g14, at the timing of rising of the clock signal SIG_CLK, the control portion 56 compares the level of the signal line output to the signal line WRb by the main control portion 4 with the predetermined threshold value, and detects that the level of the signal is changed from the low level to the high level. In addition, at the time of the time t3, similar to the waveform g15, after the main control portion 4 performs the determination, the control portion 56 outputs the driving signal SIG_B to the first motor 57A. In addition, in the example illustrated in FIG. 16, an example in which the driving signal SIG_A is output between the time t3 to time t4 is illustrated, but the driving signal SIG_B may be a signal which drives the first pointer 58A by a predetermined angle. In addition, an example in which the number of reverse rotations is 1 is illustrated in the example illustrated in FIG. 15, but not being limited thereto, the number of reverse rotations may be the number which corresponds to use.

In addition, in the example illustrated in FIG. 16, an example in which the driving signal is generated when the level of the signal input to the control portion 56 is changed from the low level to the high level, but the control portion 56 may generate the driving signal when the level of the input signal is changed from the high level to the low level.

For example, at the time of a time t4, similar to the waveform g11 and the waveform g14, at the timing of falling of the clock signal SIG_CLK, the control portion 56 compares the level of the signal line output to the signal line WRb by the main control portion 4 with the predetermined threshold value, and may detect that the level of the signal is changed from the high level to the low level. In addition, at the time of the time t4, similar to a waveform g16, after the main control portion 4 performs the determination, the control portion 56 may output the driving signal SIG_B to the first motor 57A.

In addition, when the clock signal SIG_CLK output by the main control portion 4 continues to be the high level or the low level for a period of time which is equal to or greater than the predetermined time, the control portion 56 determines that the input of the clock signal is stopped. In a case where it is determined that the input of the clock signal is stopped, the control portion 56 switches each portion provided in the first pointer driving motor unit 5B to be in a power saving mode (sleeping mode). In addition, when the clock signal SIG_CLK repeats the high level and the low level, the control portion 56 controls the portions to return from the power saving mode.

In other words, the main control portion 4 can switch the first pointer driving motor unit 5B into the power saving mode by stopping the clock signal supplied to the control portion 56.

Next, an example of the processing of the control portion 56 will be described.

Figure 17:
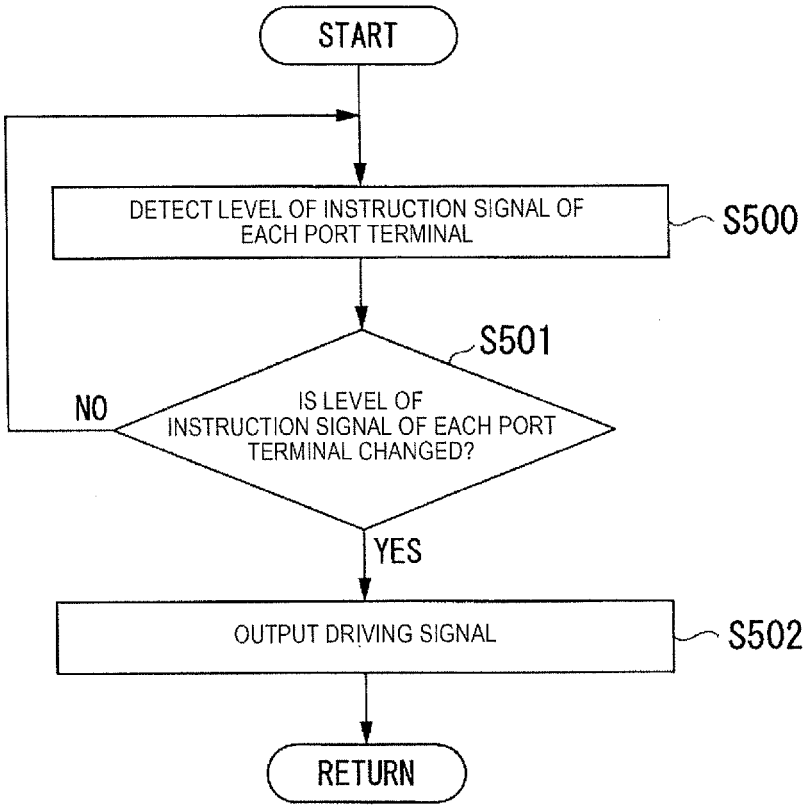
FIG. 17 is a flow chart illustrating an example of a flow of processing of the control portion 56 in the third embodiment.

FIG. 17 is a flow chart illustrating an example of the flow of the processing of the control portion 56 in the embodiment. The processing of the flow chart may be repeatedly performed, for example, in a cycle of 1 Hz.

First, the control portion 56 detects the level of each instruction signal from the first port terminal 52*a* to the sixth port terminal 52*f* (step S500).

Next, the control portion 56 compares the signal level of each detected port terminal with the predetermined threshold value, and determines whether or not the instruction signal output by the main control portion 4 is changed in accordance with the comparison result (step S501).

In a case where it is determined that the instruction signal output by the main control portion 4 is not changed (step S501; NO), the control portion 56 returns to the processing in step S500.

In a case where it is determined that the instruction signal output by the main control portion 4 is changed (step S501; YES), the control portion 56 generates the driving signal with reference to the table stored by the storage portion 55, with respect to the motor which corresponds to the port terminal of which the level is changed. Next, the control portion 56 outputs the driving signal generated in the motor that corresponds to the port terminal with reference to the table stored by the storage portion 55 (step S502).

Above, the embodiments of the present invention is described, but the present invention is not limited to the above-described embodiments, and it is possible to add various changes within a range which does not depart from the scope of the present invention.

In addition, the use of the present invention can be changed in various manners. For example, a smartphone (electronic device) worn by an operator or the like can receive vehicle speed information, rotation speed information, or remaining fuel amount information from a BLE sending and receiving apparatus which is driven by an internal combustion engine or a motor and is loaded on a vehicle, and can send a command for displaying the vehicle speed, the rotation speed, or the remaining fuel amount to a drive IC (control portion) of the pointer driving motor unit from the microcomputer (main control portion) of the smart watch. Accordingly, the pointer of the pointer driving motor unit can display the vehicle speed information or the like. In addition, it is also possible to directly mount the pointer driving motor unit on an on-board measuring instrument type display portion (inside of instrument panel or the like).

What is claimed is:

1. A pointer driving motor unit comprising:

a supporting body;

a stepping motor configured to rotate a pointer that is supported to be rotatable with respect to the supporting body;

a plurality of input portions which include a first input portion into which a first instruction signal is input from a main control portion that is connected to the supporting body from the outside of the supporting body, and a second input portion into which a second instruction signal is input from the main control portion; and a control portion configured to be provided in the supporting body, the control portion being configured to output a first driving signal that drives the pointer by a first operation to the stepping motor based at least in part on a result of comparing the first instruction signal input to the first input portion and a predetermined threshold value with each other, and the control portion being configured to output a second driving signal that drives the pointer by a second operation to the stepping motor based at least in part on a result of comparing the second instruction signal input to the second input portion and a predetermined threshold value with each other.

2. The pointer driving motor unit according to claim 1, further comprising:

a storage portion in which a correspondence table indicating a correspondence relationship including a correspondence relationship between the first input portion and the first driving signal, and a correspondence relationship between the second input portion and the second driving signal, is stored.

3. The pointer driving motor unit according to claim 1, wherein the stepping motor includes a first stepping motor that rotates a first pointer, and a second stepping motor that rotates a second pointer, and wherein the control portion outputs the first driving signal to at least one or both of the first stepping motor and the second stepping motor based at least in part on characteristics of a pulse of the first instruction signal input to the first input portion, and outputs the second driving signal to at least one or both of the first stepping motor and the second stepping motor based at least in part on characteristics of a pulse of the second instruction signal input to the second input portion.

4. The pointer driving motor unit according to claim 2, wherein the stepping motor includes a first stepping motor that rotates a first pointer, and a second stepping motor that rotates a second pointer, and wherein the control portion outputs the first driving signal to at least one or both of the first stepping motor and the second stepping motor based at least in part on characteristics of a pulse of the first instruction signal input to the first input portion, and outputs the second driving signal to at least one or both of the first stepping motor and the second stepping motor based at least in part on characteristics of a pulse of the second instruction signal input to the second input portion.

5. The pointer driving motor unit according to claim 1, wherein the input portion includes a third input portion into which a third instruction signal is input from the main control portion, and a fourth input portion into which a fourth instruction signal is input from the main control portion, wherein the stepping motor includes a first stepping motor that rotates a first pointer and a second stepping motor that rotates a second pointer, wherein the control portion outputs the first driving signal which normally rotates the first stepping motor to the first stepping motor in accordance with the pulse of the first instruction signal input to the first input portion, outputs the second driving signal which reversely rotates the first stepping motor to the first stepping motor in accordance with the pulse of second instruction signal input to the second input portion, outputs a third driving signal which normally rotates the second stepping motor to the second stepping motor in accordance with the pulse of the third instruction signal input to the third input portion, and outputs a fourth driving signal which reversely rotates the second stepping motor to the second stepping motor in accordance with the pulse of the fourth instruction signal input to the fourth input portion, and wherein the storage portion stores a correspondence relationship including a correspondence relationship between the third input portion and the third driving signal, and a correspondence relationship between the fourth input portion and the fourth driving signal.

6. The pointer driving motor unit according to claim 2, wherein the input portion includes a third input portion into which a third instruction signal is input from the main control portion, and a fourth input portion into which a fourth instruction signal is input from the main control portion, wherein the stepping motor includes a first stepping motor that rotates a first pointer and a second stepping motor that rotates a second pointer, wherein the control portion outputs the first driving signal which normally rotates the first stepping motor to the first stepping motor in accordance with the pulse of the first instruction signal input to the first input portion, outputs the second driving signal which reversely rotates the first stepping motor to the first stepping motor in accordance with the pulse of second instruction signal input to the second input portion, outputs a third driving signal which normally rotates the second stepping motor to the second stepping motor in accordance with the pulse of the third instruction signal input to the third input portion, and outputs a fourth driving signal which reversely rotates the second stepping motor to the second stepping motor in accordance with the pulse of the fourth instruction signal input to the fourth input portion, and wherein the storage portion stores a correspondence relationship including a correspondence relationship between the third input portion and the third driving signal, and a correspondence relationship between the fourth input portion and the fourth driving signal.

7. The pointer driving motor unit according to claim 3, wherein the characteristics of the pulse includes any of an amplitude of the pulse, a width of the pulse, a duty ratio, a frequency, and the number of pulses, or a combination thereof.

8. The pointer driving motor unit according to claim 4, wherein the characteristics of the pulse includes any of an amplitude of the pulse, a width of the pulse, a duty ratio, a frequency, and the number of pulses, or a combination thereof.

9. The pointer driving motor unit according to claim 5, wherein the characteristics of the pulse includes any of an amplitude of the pulse, a width of the pulse, a duty ratio, a frequency, and the number of pulses, or a combination thereof.

10. The pointer driving motor unit according to claim 6, wherein the characteristics of the pulse includes any of an amplitude of the pulse, a width of the pulse, a duty ratio, a frequency, and the number of pulses, or a combination thereof.

11. A multifunctional electronic device which is capable of indicating a time, as a time piece by the pointer, the device comprising:

the pointer driving motor unit according to claim 1;

a substrate on which the main control portion is disposed;

a connection portion which connects the main control portion to each of the plural input portions; and a mounting portion which is wearable by a user.

12. A control method of a pointer driving motor unit including a supporting body, a stepping motor which rotates a pointer that is supported to be rotatable with respect to the supporting body; a plurality of input portions which include a first input portion into which a first instruction signal is input from a main control portion that is connected to the supporting body from the outside of the supporting body, and a second input portion into which a second instruction signal is input from the main control portion; and a control portion which is provided in the supporting body, wherein the control portion outputs a first driving signal that drives the pointer by a first operation to the stepping motor based on a result of comparing the first instruction signal input to the first input portion and a predetermined threshold value with each other, and outputs a second driving signal that drives the pointer by a second operation to the stepping motor based on a result of comparing the second instruction signal input to the second input portion and a predetermined threshold value with each other.

* * * * *